US006714744B2

(12) United States Patent
Arima

(10) Patent No.: US 6,714,744 B2
(45) Date of Patent: Mar. 30, 2004

(54) PRINTING APPARATUS, AND INFORMING METHOD IN PRINTING APPARATUS

(75) Inventor: Kazunori Arima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/748,554

(22) Filed: Dec. 26, 2000

(65) Prior Publication Data

US 2001/0016122 A1 Aug. 23, 2001

(30) Foreign Application Priority Data

Dec. 27, 1999 (JP) ..... 11-371582
Dec. 22, 2000 (JP) ..... 2000-391379

(51) Int. Cl.[7] ..... G03G 15/08
(52) U.S. Cl. ..... 399/23; 399/24
(58) Field of Search ..... 399/23, 24, 27

(56) References Cited

U.S. PATENT DOCUMENTS 5,594,529 A 1/1997 Yamashita et al.
6,023,593 A * 2/2000 Tomidokoro ..... 399/8
6,028,674 A * 2/2000 Tognazzini ..... 358/1.13
6,113,208 A 9/2000 Benjamin et al.
6,233,409 B1 * 5/2001 Haines et al. ..... 399/10
2002/0059111 A1 * 5/2002 Ding et al. ..... 705/26

FOREIGN PATENT DOCUMENTS

JP 5-254696 * 10/1993
JP 10-191453 7/1998
JP A 10-191453 7/1998

* cited by examiner

*Primary Examiner*—Quana M. Grainger
(74) *Attorney, Agent, or Firm*—Robin, Blecker & Daley

(57) ABSTRACT

The remaining amount of expendables such as paper sheets or the like is computed (step S202), and it is checked after completion of a print process if the remaining amount is smaller than a threshold value which is set in advance (step S204). If it is determined that the remaining amount is smaller than the threshold value, the user is alerted to that determination result (step S205). As a result, the user can take a measure before expendables completely run out.

36 Claims, 23 Drawing Sheets

FIG. 19

| 19D MACHINE TYPE INFORMATION | AAA | | |
|---|---|---|---|
| | 19A PAPER | 19B INK | 19C PHOTOSENSITIVE BODY |
| 19E EXPENDABLES TYPE INFORMATION | BBB | CCC | DDD |
| 19F STOCK INFORMATION | 1000 SHEETS | 2 | 0 |
| 19G STOCK THRESHOLD VALUE | 100 SHEETS | 1 | 0 |
| 19H SEARCH TIMING | BEFORE SEVEN DAYS | BEFORE THREE DAYS | BEFORE SEVEN DAYS |
| 19I SEARCH CYCLE | ONE DAY | ONE DAY | ONE DAY |
| 19J PRICE CONDITION | 20% OFF | 20% OFF | 20% OFF |
| 19K ORDER QUANTITY OF EXPENDABLES | 1000 SHEETS | 3 | 1 |
| 19L GEOGRAPHICAL CONDITION | NEAR | NEAR | NEAR |

FIG. 21A

CURRENT DATE : NOVEMBER, 31

21A

| SEARCH CONDITIONS | | | | |
|---|---|---|---|---|
| TYPE OF MACHINE : AAA | TYPE OF EXPENDABLES : CCC | ORDER QUANTITY OF EXPENDABLES : 2 | PRICE CONDITION : 20% OFF | GEOGRAPHICAL CONDITION : WITHIN ONE HOUR BY CAR |

FIG. 21B

21B

| SEARCH RESULTS | | | | | |
|---|---|---|---|---|---|
| COMPANY NAME | UNIT PRINCE | MINIMUM ORDER QUANTITY OF EXPENDABLES | LOCATION OF RETAILER | NUMBER OF DAYS REQUIRED FOR DELIVERY : | REMARKS |
| XXX | 70 ( 30% OFF ) | 10 | ○○○○ | TWO DAYS | |
| YYY | 80 ( 20% OFF ) | 2 | ○×○× | THREE DAYS | UNIT COST OF ¥66 FOR 20 OR MORE EXPENDABLES |

FIG. 23A

CURRENT DATE : NOVEMBER, 31

23A

| SEARCH CONDITIONS | | | | |
|---|---|---|---|---|
| TYPE OF MACHINE : AAA<br>TYPE OF MACHINE : GGG | TYPE OF EXPENDABLES : CCC | ORDER QUANTITY OF EXPENDABLES : 4 | PRICE CONDITION : 20% OFF | GEOGRAPHICAL CONDITION : WITHIN ONE HOUR BY CAR |

FIG. 23B

23B

| SEARCH RESULTS | | | | | |
|---|---|---|---|---|---|
| COMPANY NAME | UNIT PRINCE | MINIMUM ORDER QUANTITY OF EXPENDABLES | LOCATION OF RETAILER | NUMBER OF DAYS REQUIRED FOR DELIVERY : | REMARKS |
| XXX | 70 ( 30% OFF ) | 10 | ○○○○ | TWO DAYS | |
| YYY | 80 ( 20% OFF ) | 2 | ○×○× | THREE DAYS | UNIT COST OF ¥66 FOR 20 OR MORE EXPENDABLES |

PRINTING APPARATUS, AND INFORMING METHOD IN PRINTING APPARATUS

FIELD OF THE INVENTION

The present invention relates to a printing apparatus such as a printer, copying machine, or the like and, more particularly, to a printing apparatus which copes with a short supply of expendables.

BACKGROUND OF THE INVENTION

When expendables such as ink as a printing agent, paper sheets as a printing medium, or the like have run out, the conventional printing apparatus alerts the user to that state at that time, and the user supplies expendables in accordance with the information. A printing apparatus automatically ordering to a predetermined supplier based on supplier information stored in the apparatus in case of short supply of expendables is also provided.

However, it is very troublesome to supply expendables which have run out during a print process. Also, when expendables run short, the user must place an order to a retailer as a supplier of them, and a print process is suspended until the expendables are supplied.

Further, The main objective of the conventional manner of automatically ordering is to prevent expendables or stocks from running out. Thus, considering the cost and the like, useful retailers for users is not always set.

Further, when printing through use of a network, where there is a plurality of printing apparatuses, burdens on a system manager may increase since the manager must respectively manage each of the printing apparatuses and expendables such as toner and paper used in each of the printing apparatuses. A system which can easily manage expendables under such a network situation and can conduct useful ordering for users is desirable.

SUMMARY OF THE INVENTION

It is an object of the present invention to provide a printing apparatus which can quickly cope with a short supply of expendables, and an information method in the printing apparatus.

It is another object of the present invention to provide a system, apparatus, method, medium, and program for managing expendables which can be ordered under useful conditions for users and can cope with a printing system under a network circumstance.

According to the present invention, there is provided a printing apparatus comprising:

measuring means for measuring a remaining amount of a predetermined expendable;

determination means for determining if the remaining amount is smaller than a threshold value, which is set in advance; and information means for, when said determination means determines that the remaining amount is smaller than the threshold value, informing an user of that determination result.

According to the present invention, there is also provided an informing method for a printing apparatus, comprising:

the measuring step of measuring a remaining amount of a predetermined expendable;

the determination step of determining if the remaining amount is smaller than a threshold value, which is set in advance; and the information step of informing an user of a determination result when it is determined in the determination step that the remaining amount is smaller than the threshold value.

According to the present invention, there is also provided a recording medium which records a program for making, for the purpose of informing a printing apparatus, a computer function as:

measuring means for measuring a remaining amount of a predetermined expendable;

determination means for determining if the remaining amount is smaller than a threshold value, which is set in advance; and information means for, when said determination means determines that the remaining amount is smaller than the threshold value, informing an user of that determination result.

According to the present invention, there is also provided a printing apparatus comprising:

control means for issuing a search instruction for searching for supplier information of expendable used in the printing apparatus when the remaining amount or the use amount of expendables reaches a predetermined amount.

According to the present invention, there is also provided a method for a printing apparatus comprising:

the control step of issuing search instruction for searching for supplier information of expendables used in the printing apparatus when the remaining amount or the use amount of expendables reaches a predetermined amount.

According to the present invention, there is also provided a recording medium which records a program for making a computer for a printing apparatus function as:

control means for issuing a search instruction for searching for supplier information of expendables used in the printing apparatus when the remaining amount or the use amount of expendables reaches a predetermined amount.

According to the present invention, there is also provided a program for making a computer for a printing apparatus function as:

control means for issuing a search instruction for searching for supplier information of expendables used in the printing apparatus when the remaining amount or the use amount of expendables reaches a predetermined amount.

According to the present invention, there is also provided an external apparatus connected to a printing apparatus comprising:

control means for issuing a search instruction of expendables to an external database when it is informed that the remaining amount or the use amount of expendables which is detected by the printing apparatus reaches to a predetermined amount.

According to the present invention, there is also provided a method for an external apparatus connected to a printing apparatus comprising:

the control step of issuing a search instruction of expendables to an external database when it is informed that the remaining amount or the use amount of expendables which is detected by the printing apparatus reaches to a predetermined amount.

According to the present invention, there is also provided a recording medium which records a program for making a computer connected to a printing apparatus function as:

control means for issuing a search instruction of expendables to an external database when it is informed that the remaining amount or the use amount of expendables which is detected by the printing apparatus reaches to a predetermined amount.

According to the present invention, there is also provided a program for making a computer connected to a printing apparatus function as:

control means for issuing a search instruction of expendables to an external database when it is informed that the remaining amount or the use amount of expendables which is detected by the printing apparatus reaches to a predetermined amount.

According to the present invention, there is also provided an external apparatus connected to a printing apparatus comprising:

receiving means for receiving a first search instruction from the printing apparatus, and control means for issuing a second search instruction based on the received first search instruction to an external database via the Internet.

According to the present invention, there is also provided a method for an external apparatus connected to a printing apparatus comprising:

the receiving step of receiving a first search instruction from the printing apparatus, and the control step for issuing a second search instruction based on the received first search instruction to an external database via the Internet.

According to the present invention, there is also provided a recording medium which records a program for making a computer connected to a printing apparatus function as:

receiving means for receiving a first search instruction from the printing apparatus, and control means for issuing a second search instruction based on the received first search instruction to an external database via the Internet.

According to the present invention, there is also provided a program for making a computer connected to a printing apparatus function as:

receiving means for receiving a first search instruction from the printing apparatus, and control means for issuing a second search instruction based on the received first search instruction to an external database via the Internet.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 19 is a table showing an example of search condition contents set in a storage unit;

FIGS. 21A and 21B are views showing an example of search results displayed on the display unit of the printing apparatus;

FIGS. 23A and 23B are views showing an example of search results displayed on the display unit of the manager computer.

DETAILED DESCRIPTION OF THE PREFERRED EMBODIMENTS

Preferred embodiments of the present invention will now be described in detail in accordance with the accompanying drawings.

(First Embodiment)

Figure 1:
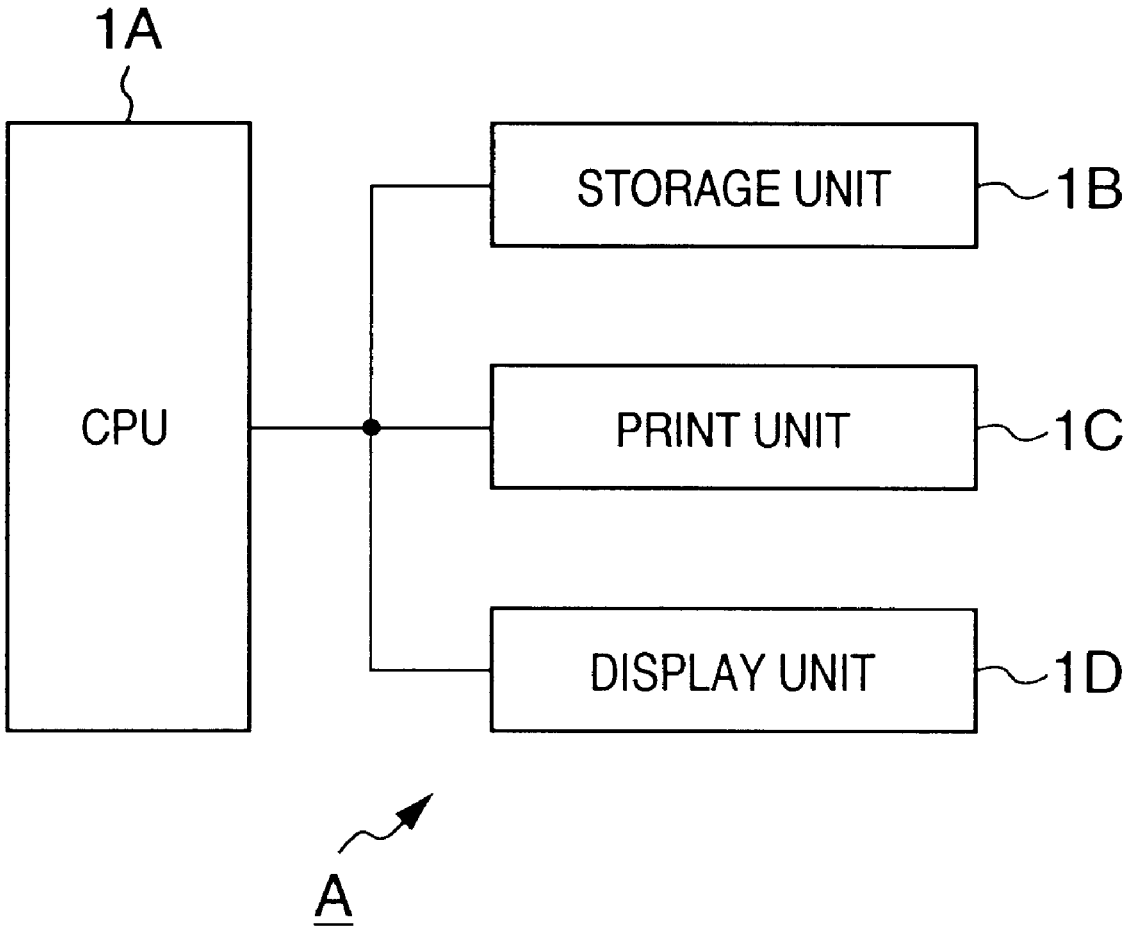
FIG. 1 is a block diagram of a printing apparatus A according to an embodiment of the present invention.

FIG. 1 is a block diagram of a printing apparatus A according to an embodiment of the present invention.

A printing apparatus A comprises a CPU 1A for controlling this apparatus, a storage unit 1B required upon controlling the apparatus, a print unit 1C for performing a print process, and a display unit 1D such as a display for displaying predetermined information for the user. Note that expendables to be detected in the printing apparatus A are paper sheets used in the print process. The CPU 1A controls each of the components such as the storage unit 1B, the print unit 1C, the display unit 1D, an input unit 7A and a communications unit 12A which are described later, and the like.

Figure 2:
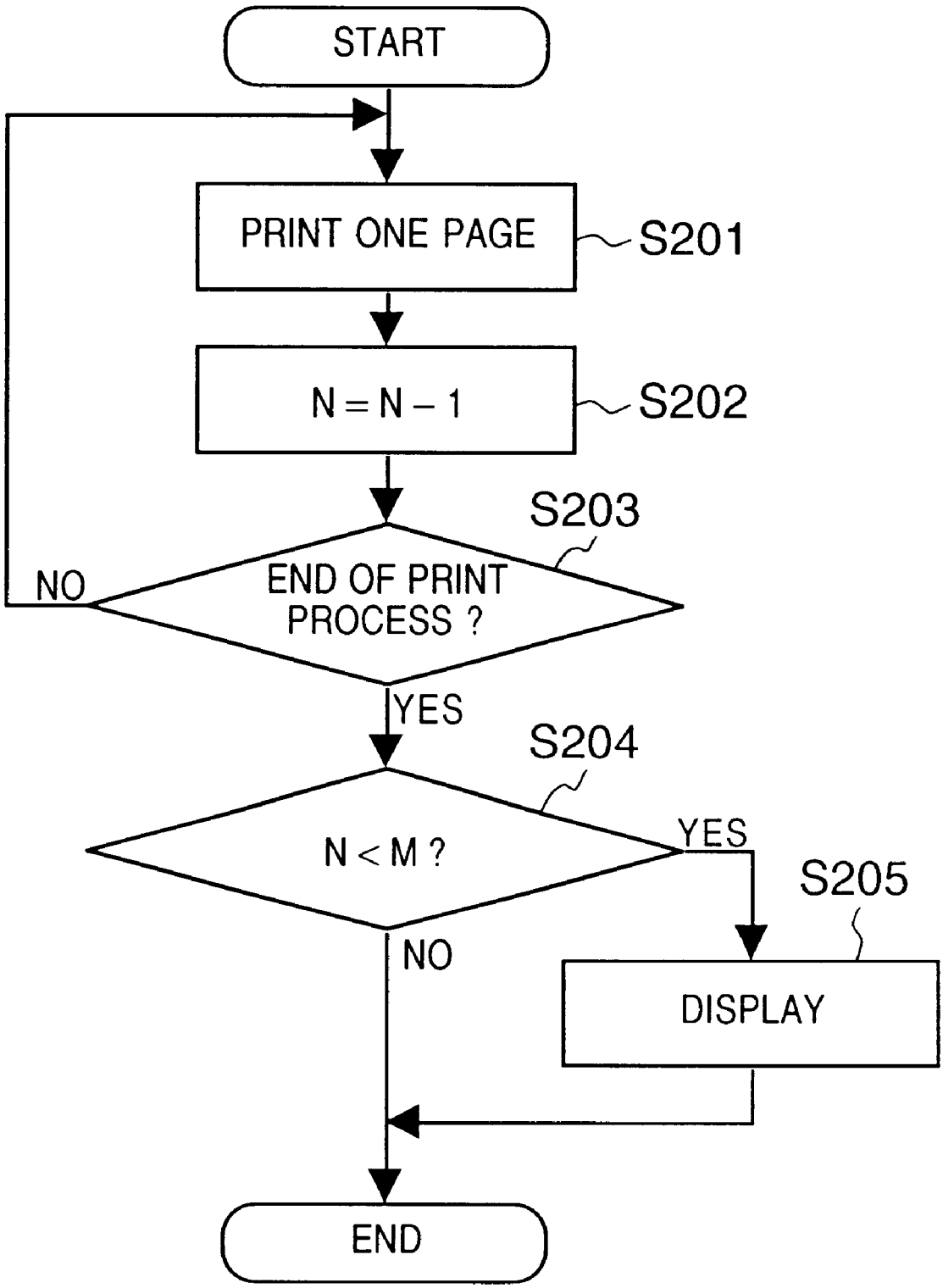
FIG. 2 is a flow chart showing the process in the printing apparatus A.

FIG. 2 is a flow chart showing the process in the printing apparatus A. Note that N represents the remaining number of paper sheets stocked in the printing apparatus A. Also, M (>0) represents a threshold value at which out-of-paper information is issued. The number N of paper sheets and threshold value M are saved in the storage unit 1B. Note that the default value of the remaining number N of paper sheets is the number of paper sheets stocked in the printing apparatus A upon feeding paper sheets, but that value need not always be accurate and can be approximate. That is, the user need only be informed when paper sheets are about to run out.

In step S201, a print process for one page is done. In step S202, the number of sheets for one page is decremented from the remaining number N of paper sheets. That is, the remaining number N of paper sheets=$N-1$.

It is checked in step S203 if the instructed print process is complete. If NO in step S203, the flow returns to step S201 to print the next page. If YES in step S203, the flow advances to step S204.

It is checked in step S204 if the remaining number N of paper sheets is smaller than the threshold value M. If NO in step S204, i.e., N≧M, the flow ends.

On the other hand, if YES in step S204, i.e., N <M, the flow advances to step 205 to display on the display unit 1D a message indicating that the remaining number of paper sheets is small, i.e., informs the user that paper sheets will run out soon. After that, flow ends.

In this manner, since the apparatus warns the user that paper sheets will run out soon before paper sheets run out, the user can replenish paper sheets at an appropriate timing, and paper sheets can be prevented from suddenly running out during the print process.

In the process shown in FIG. 2, whether or not an information is generated is determined by comparing the remaining number of paper sheets with the threshold value after the print process of all pages is completed, but may be determined before the print process.

Figure 3:
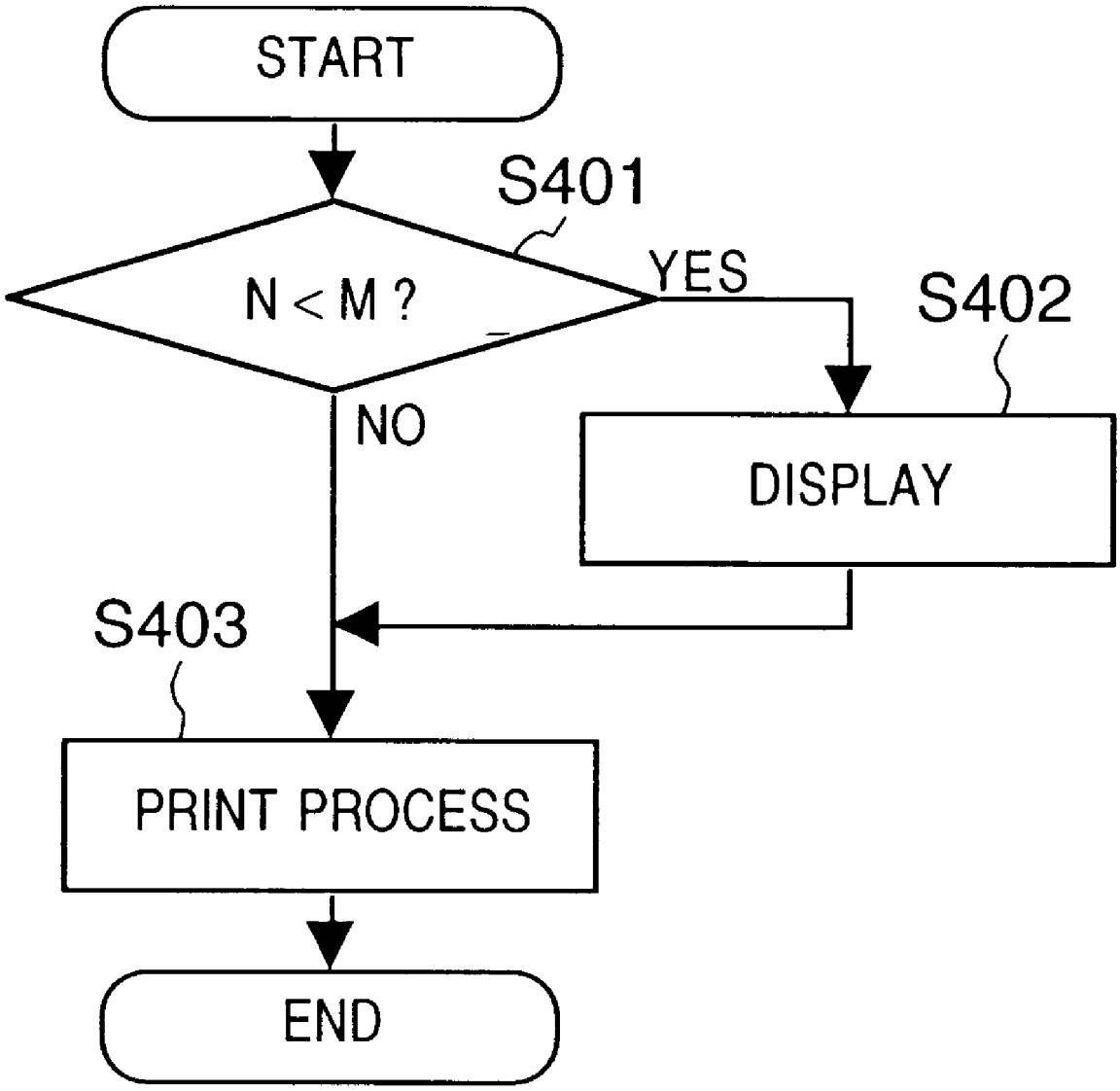
FIG. 3 is a flow chart showing another example of the process in the printing apparatus A.

FIG. 3 is a flow chart showing the process in that case.

In step S401, the remaining number N of paper sheets is compared with the threshold value M. If N≧M, the flow advances to step S403 to execute a print process.

If N<M, the flow advances to step S402 to display on the display unit 1D a message that paper sheets will run out soon and, after that, a print process is executed (step S403).

Figure 4:
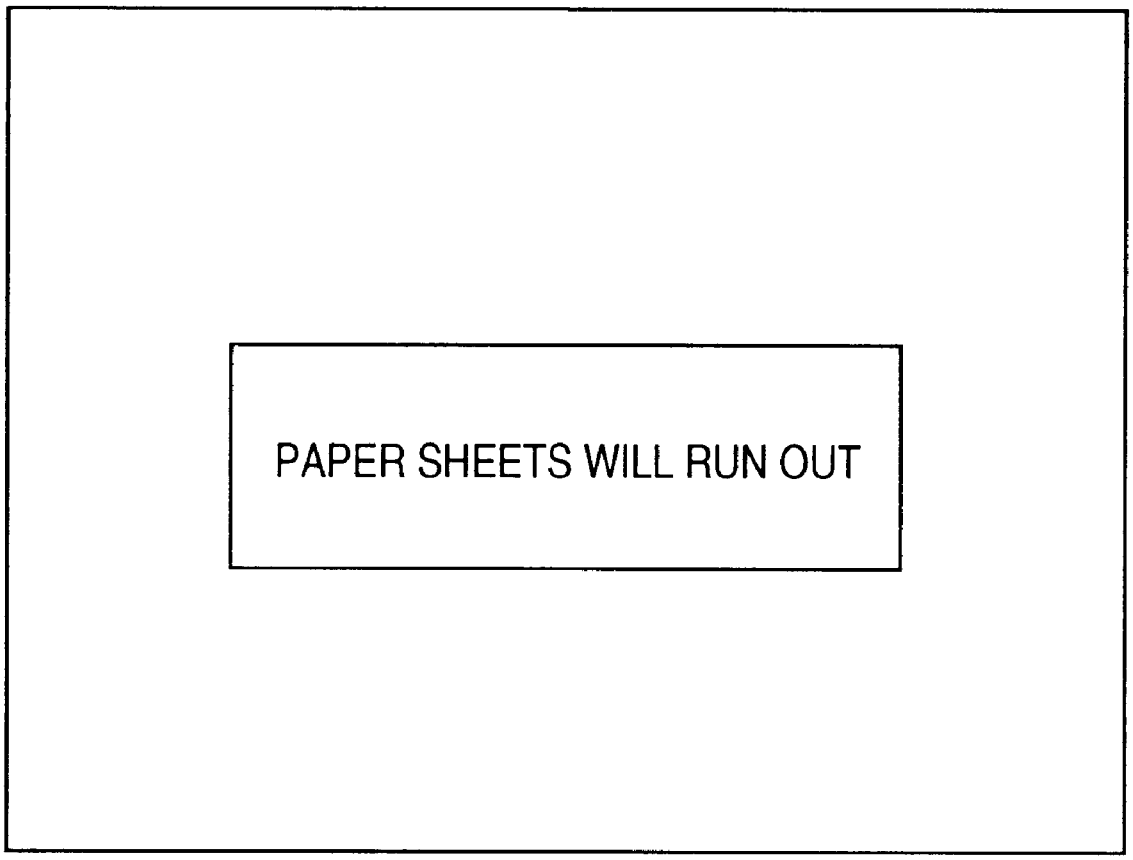
FIG. 4 shows a display example of a display unit 1D when the apparatus warns the user that paper sheets are running short.
Figure 5:
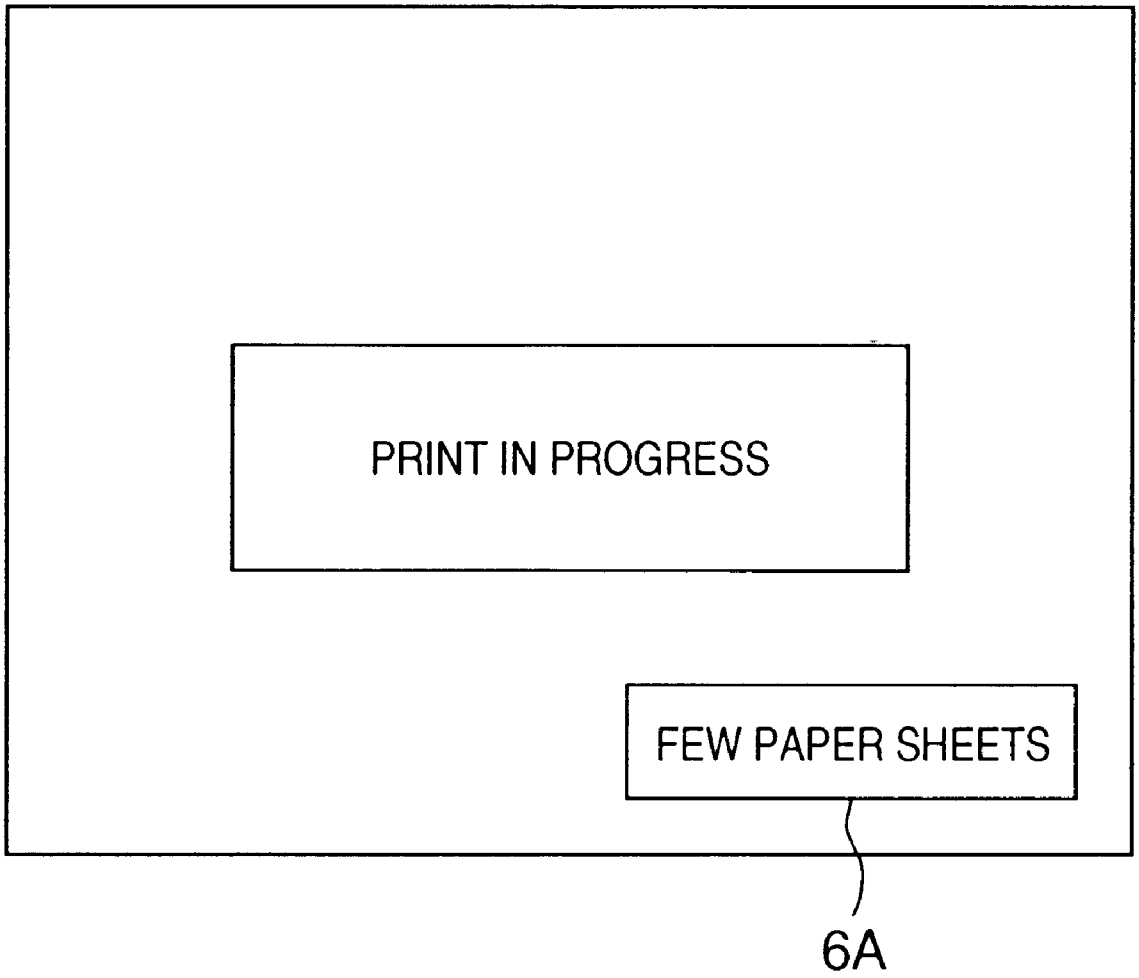
FIG. 5 shows a display example of the display unit 1D when the apparatus warns the user that paper sheets are running short during a print process.

FIG. 4 shows a display example on the display unit 1D when the apparatus informs the user that paper sheets are running short. This message may be kept displayed until the user makes a given operation on the printing apparatus. Also, when the user has made the given operation and starts another process, a small dialog box 6A may be displayed on a given corner of the screen, as shown in FIG. 5.

In the aforementioned flow chart, the remaining number N of paper sheets is compared with the threshold value M before or after the print process. Alternatively, such process may be done every time each page is printed.

The remaining number N of paper sheets is computed by counting the number of printed pages. Alternatively, a sensor for detecting the remaining number of paper sheets may be added, and the remaining number of paper sheets computed based on the detection value of that sensor may be compared with the threshold value. As such sensor, a sensor for detecting the total weight of remaining paper sheets, a sensor for detecting the total height of remaining paper sheets, or the like may be used. In such case, the number of paper sheets need not always be strictly and accurately detected like the default value of the remaining number N of paper sheets.

A printing apparatus B that displays information of a supplier that deals with expendables will be explained below. Such supplier includes a retailer that deals with expendables, a supply department of a company or the like where the printing apparatus is equipped, and the like. In this embodiment, the supplier will be explained as a retailer.

Figure 6:
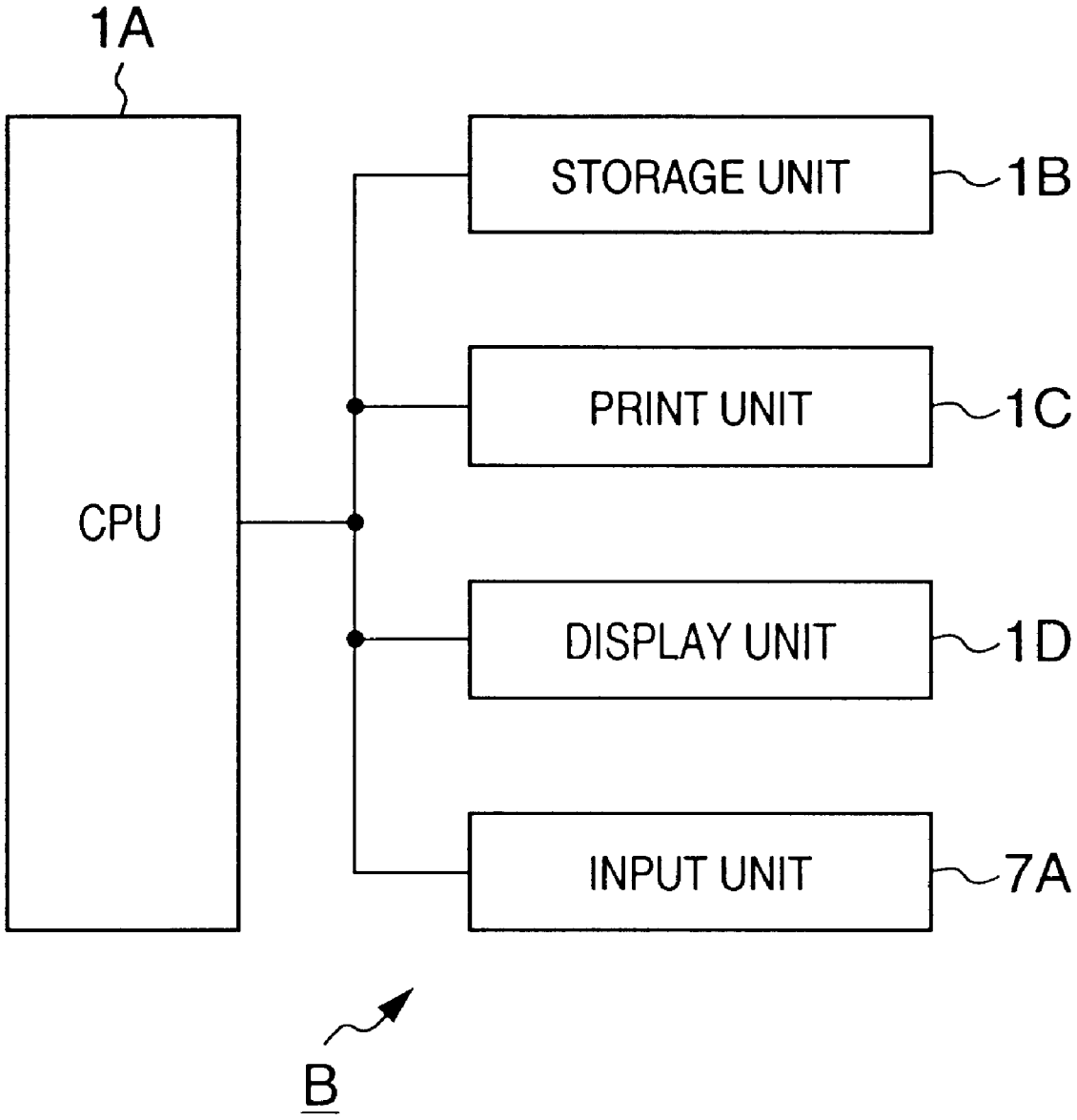
FIG. 6 is a block diagram of a printing apparatus B according to another embodiment of the present invention.

FIG. 6 is a block diagram of the printing apparatus B which has an arrangement obtained by adding an input unit 7A to that of the printing apparatus 1A shown in FIG. 1. The user inputs retailer information from the input unit 7A, and can store it in the storage unit 1B.

Figure 7:
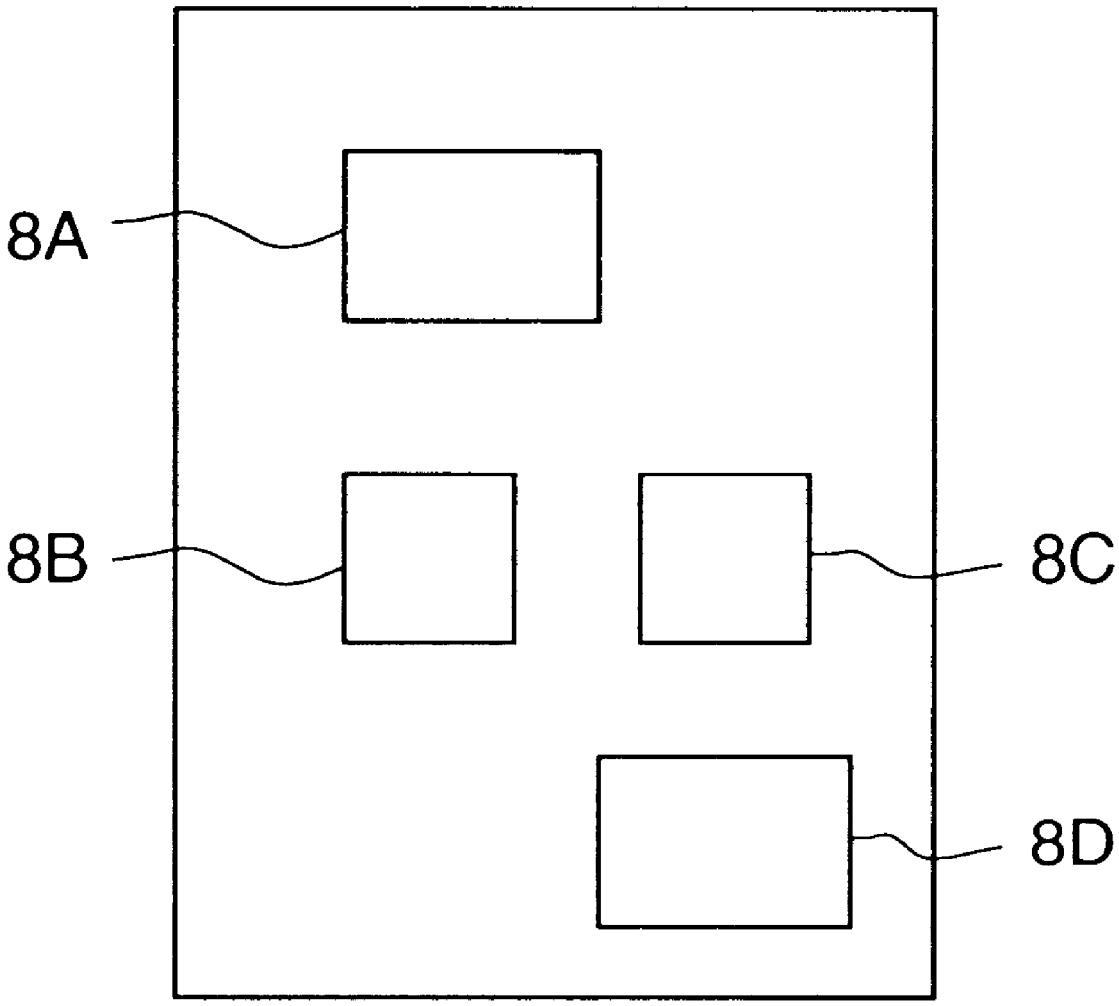
FIG. 7 shows an example of the arrangement of an input unit 7A.
Figure 8:
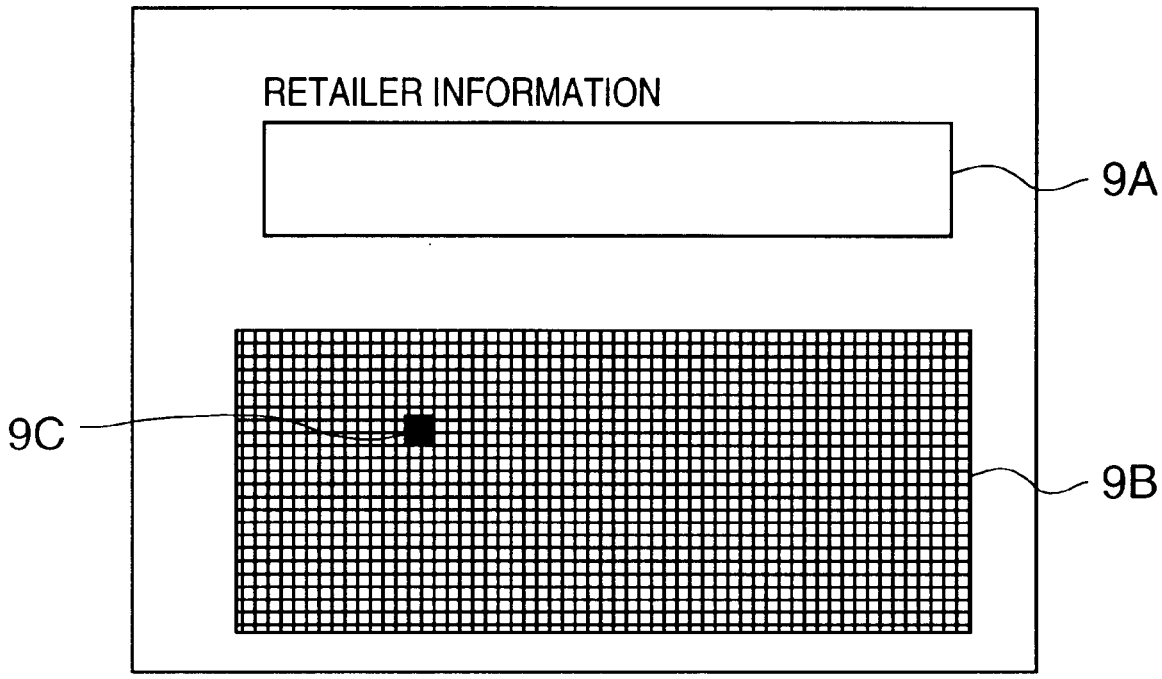
FIG. 8 shows an example of an input window of retailer information.

FIG. 7 shows an example of the arrangement of the input unit 7A. Upon depression of a button 8A, the display unit 1D displays an input window of retailer information. FIG. 8 shows an example of such input window. Reference numeral 9A denotes an area for inputting retailer information.

In this case, a keyboard 9B is displayed on the screen. On the keyboard 9B, a cursor 9*c* that can be moved by buttons 8B and 8C is displayed. When the user moves the cursor 9*c* to a target character or the like and then presses a button 8D, that character or the like is displayed on the input area 9A, and retailer information can be input sequentially.

Figure 9:
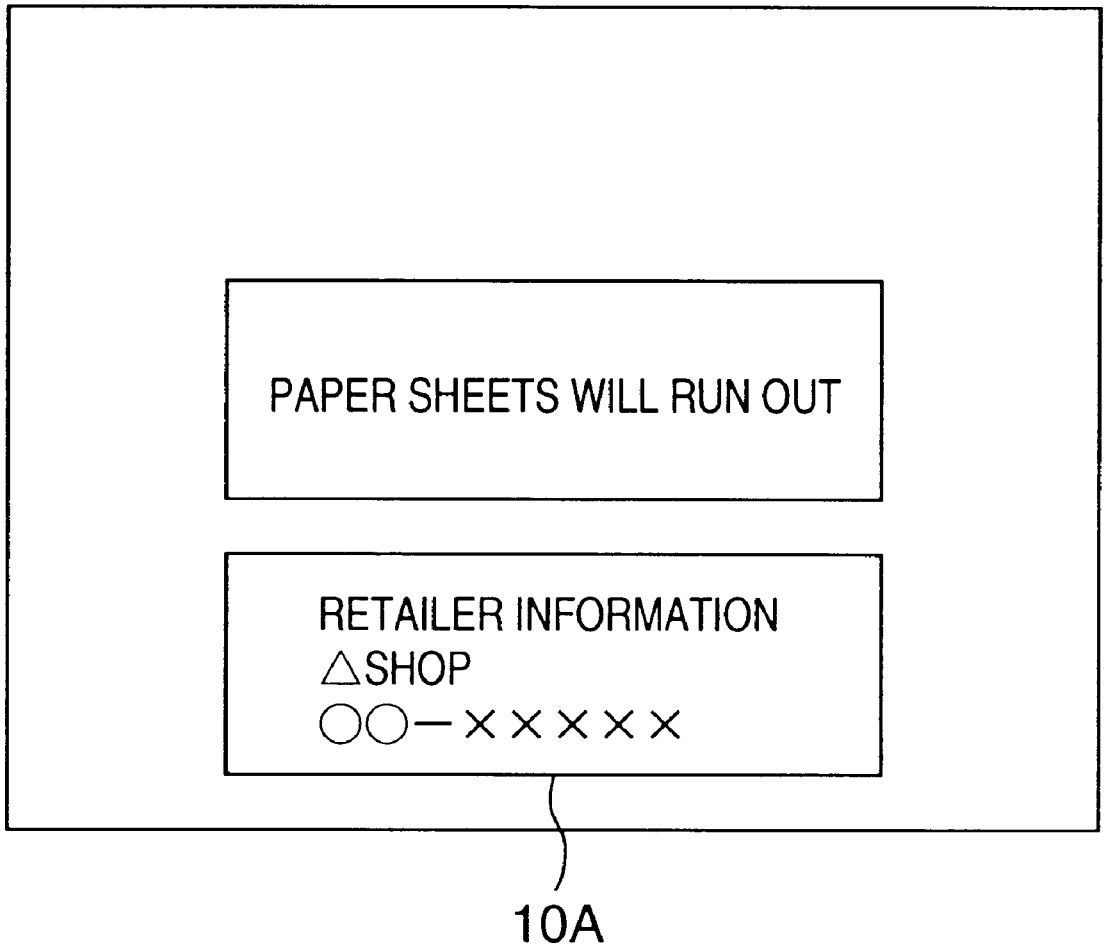
FIG. 9 shows a display example of retailer information.

The retailer information input in this manner and stored in the storage unit 1B is displayed on the display unit 1D simultaneously with or after the aforementioned message (FIGS. 2 and 3) indicating that paper sheets are running short. FIG. 9 shows a display example on the display unit 1D in the former case, and retailer information is displayed in a dialog box 10A.

As a result, the user can immediately contact that retailer and can replenish paper sheets before they actually run out.

Figure 10:
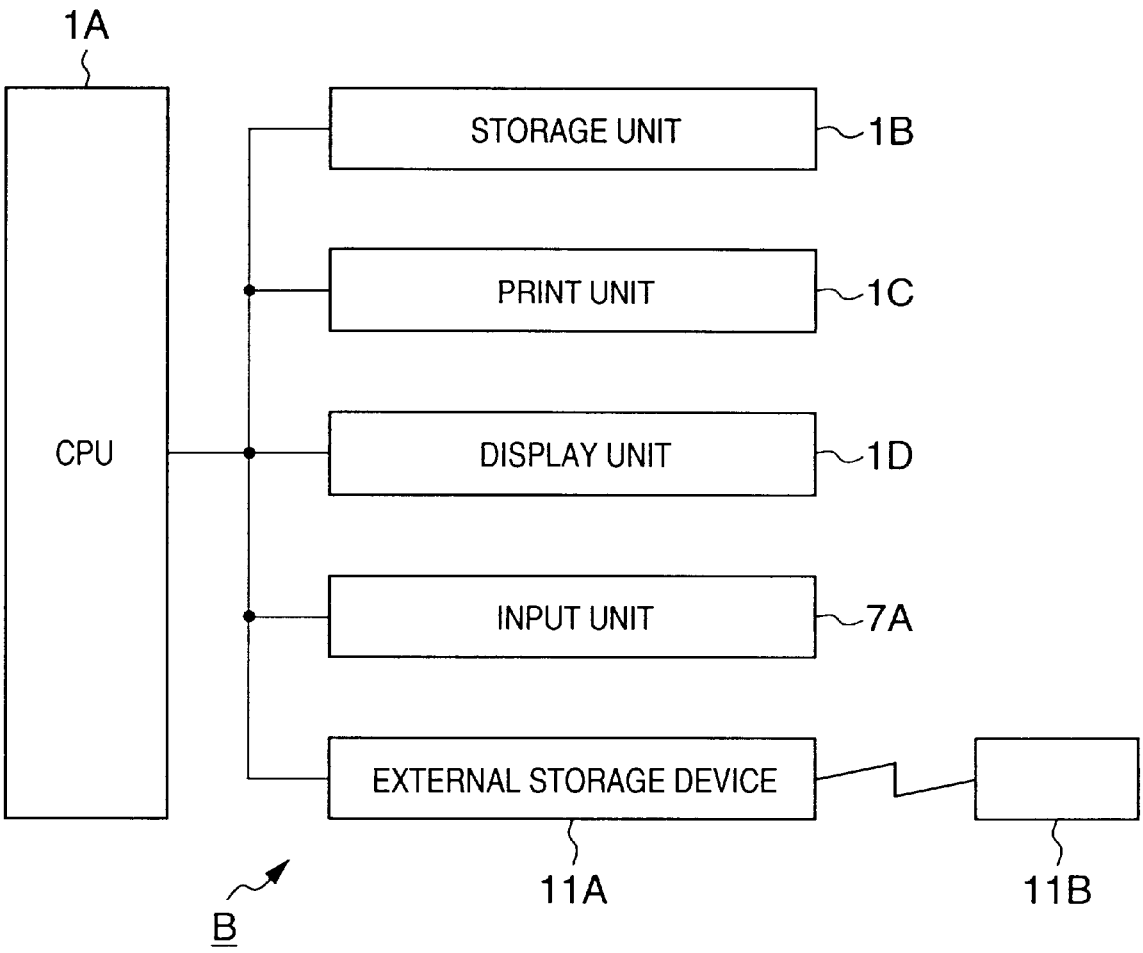
FIG. 10 is a block diagram showing another example of the arrangement of the printing apparatus B.

Note that retailer information may be input by loading a removable medium 11B that records the retailer information into an external storage device 11A connected to the printing apparatus B, as shown in FIG. 10. As the removable medium 11B, for example, a magnetic card may be used. If the magnetic card can be distributed with low cost, the retailer may offer a free magnetic card to the user.

A printing apparatus C that records therein data unique to the apparatus, and selectively displays retailer information based on that unique information will be explained below.

Figure 11:
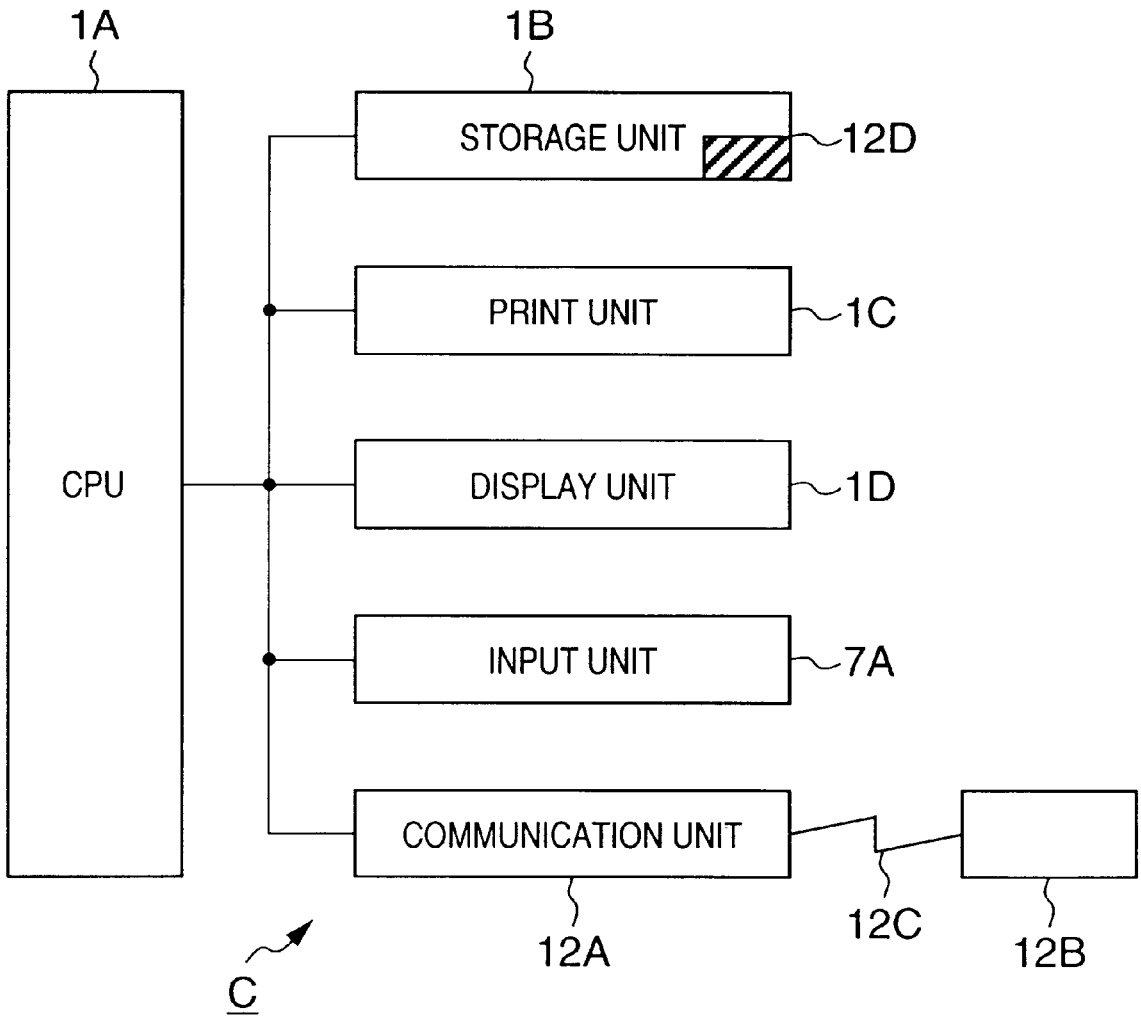
FIG. 11 is a block diagram of a printing apparatus C according to still another embodiment of the present invention.

FIG. 11 is a block diagram of the printing apparatus C which has an arrangement obtained by adding an input unit 1A and a communication unit 12A such as a modem or the like that accesses an external database 12 via a telephone line 12C to the arrangement shown in FIG. 1. Also, data 12D unique to the apparatus such as an installation address of the printing apparatus C or the like is recorded in the storage unit 1B.

If it is determined in the process shown in FIG. 2 or 3 that paper sheets are running short, the apparatus shown in FIG. 11 accesses the database 12B via the communication unit 12A to acquire retailer information stored in the database 12B. In this case, the communication unit 12A transfers the data 12D unique to the apparatus to the database 12B to search for retailer information associated with that unique data, e.g., information that pertains to a retailer near the installation address of the printing apparatus C, and that information is supplied to the printing apparatus C.

Figure 12:
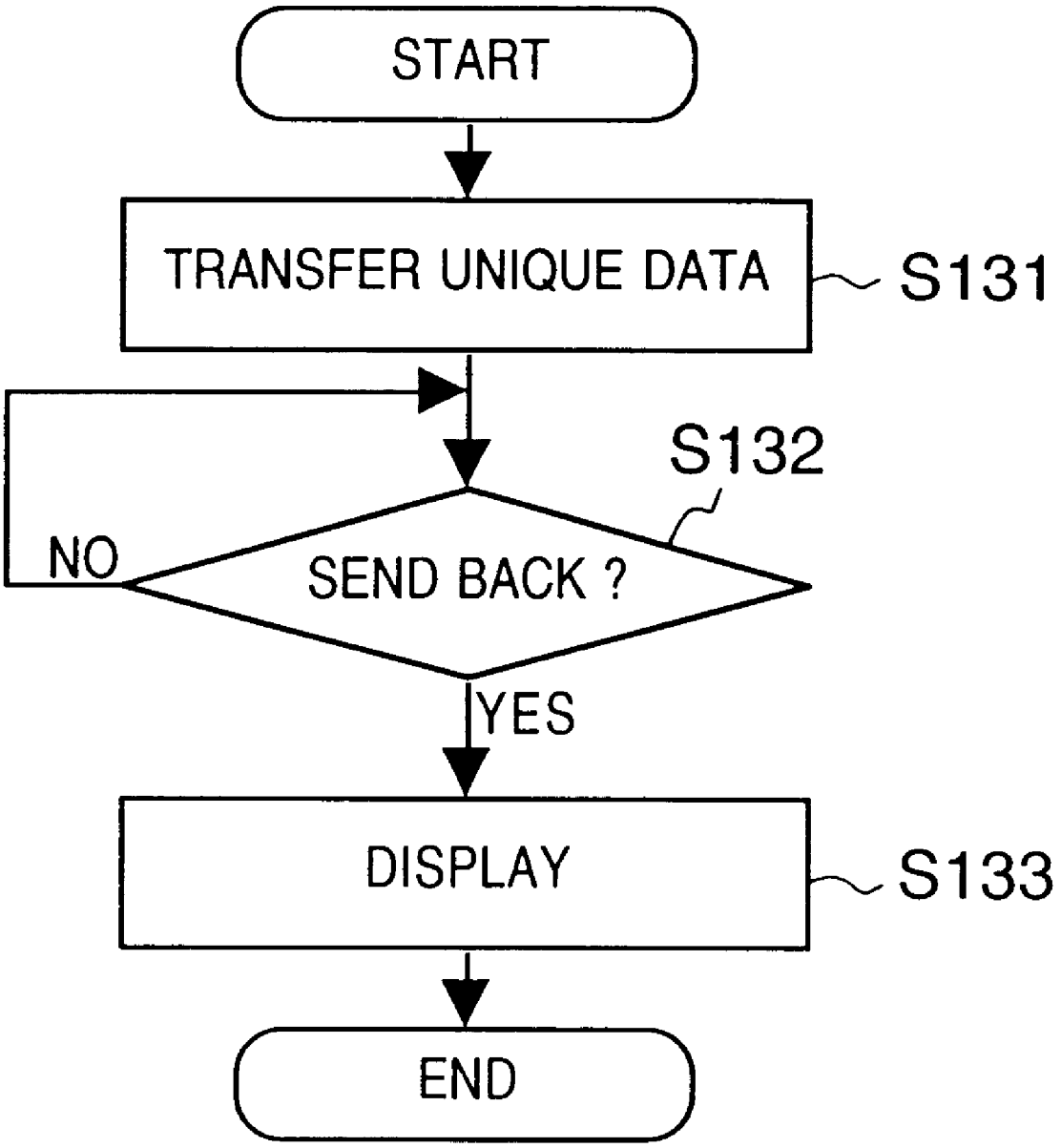
FIG. 12 is a flow chart of unique data transfer.
Figure 13:
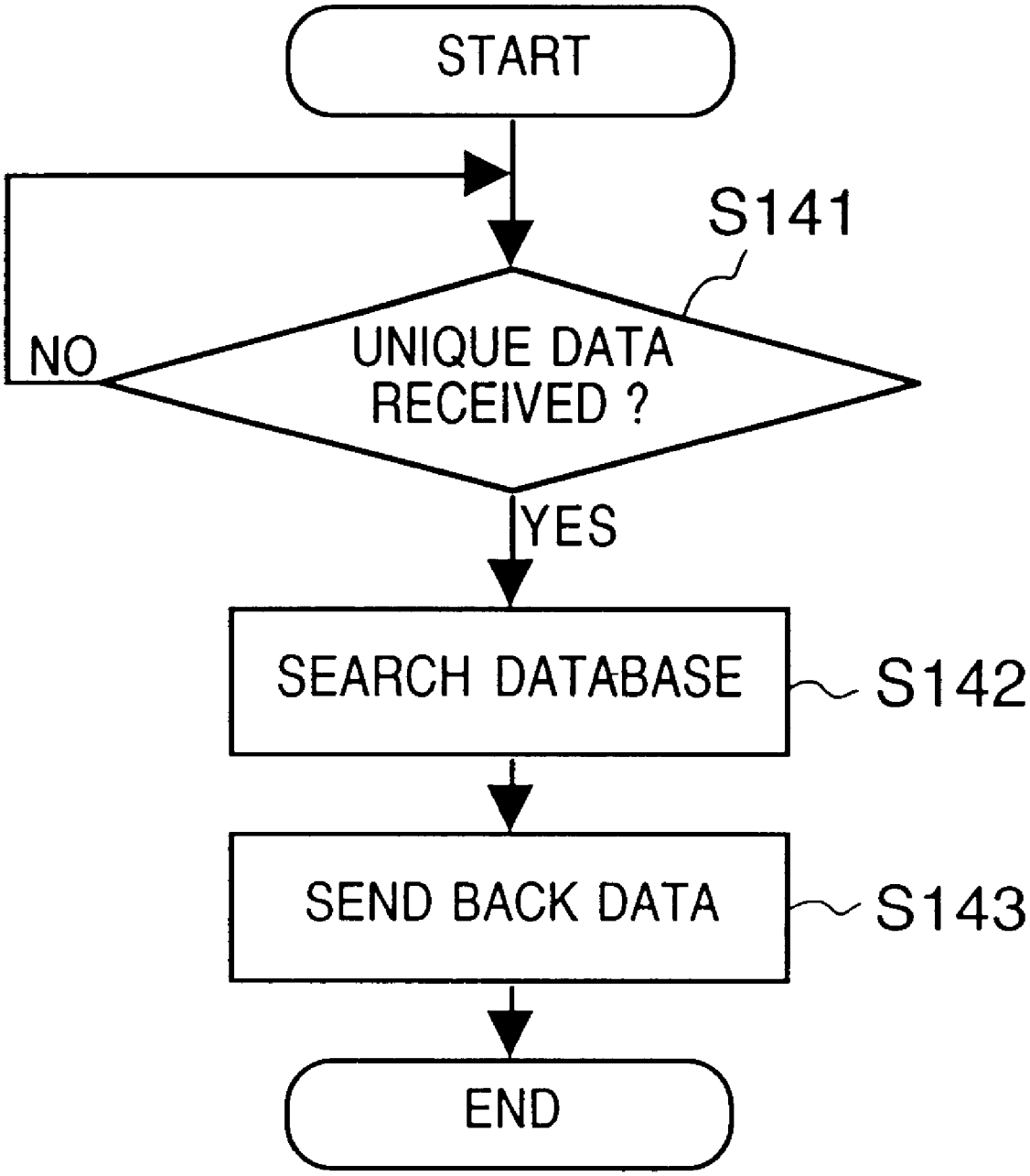
FIG. 13 is a flow chart showing the process in a database 12B.

FIGS. 12 and 13 are flow charts showing that process.

The printing apparatus C sends the unique data 12D to the database 12B (step S131). After that, the printing apparatus C waits for search result data sent from the database 12B (step S132). Upon receiving retailer information, the printing apparatus C displays the received data (step S133), thus ending the display process of the retailer information. Note that the retailer information is stored in the storage unit 1B.

FIG. 13 is a flow chart showing the process of the database 12B. The database 12B waits for the unique data 12D sent from the printing apparatus C (step S141). Upon receiving the unique data, information of, e.g., a retailer near the installation address of the printing apparatus C is searched for (step S142), and is sent back to the printing apparatus C (step S143).

In these processes, if paper sheets are running short, the printing apparatus accesses the database 12B at that time. However, the printing apparatus need not access the database every time paper sheets are running short. This is because retailer information is rarely frequently changed. Hence, the printing apparatus may access the database once per several months.

In the aforementioned example, the database 12B is accessed via the telephone line 12C. Alternatively, data stored in the database 12B may be supplied to the external storage device 11A shown in FIG. 10 via a removable medium. For example, a CD-ROM or the like as a large-size storage medium may be used.

A printing apparatus D that executes a process for ordering expendables will be explained below.

Figure 14:
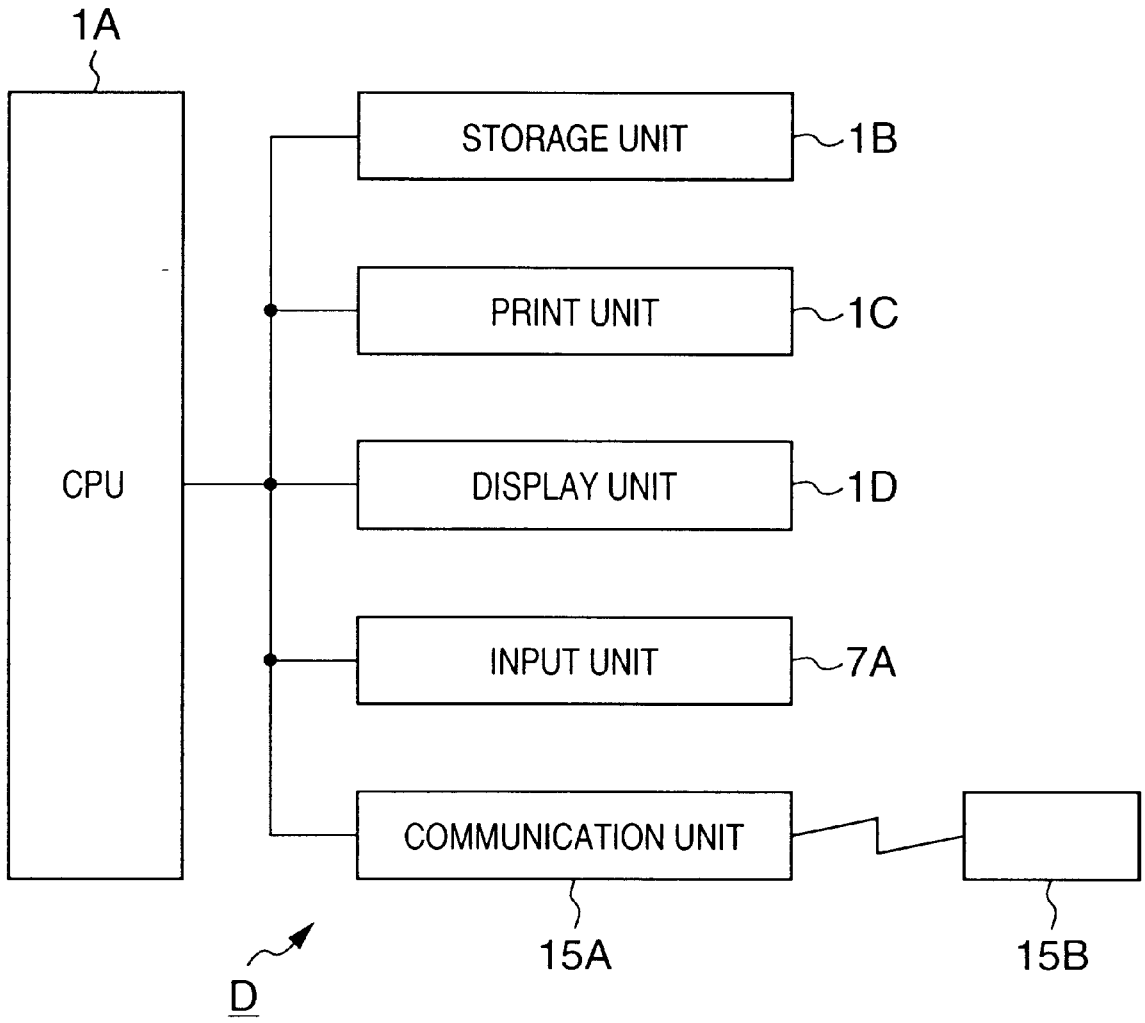
FIG. 14 is a block diagram of a printing apparatus D according to still another embodiment of the present invention.

FIG. 14 is a block diagram of such printing apparatus, which has an arrangement obtained by adding an input unit 7A and a communication unit 15A such as a modem or the like for connecting a provider 15B to the arrangement shown in FIG. 1. The printing apparatus D connects the provider 15B via the communication unit 15A and places an order by browsing the Internet.

Figure 15:
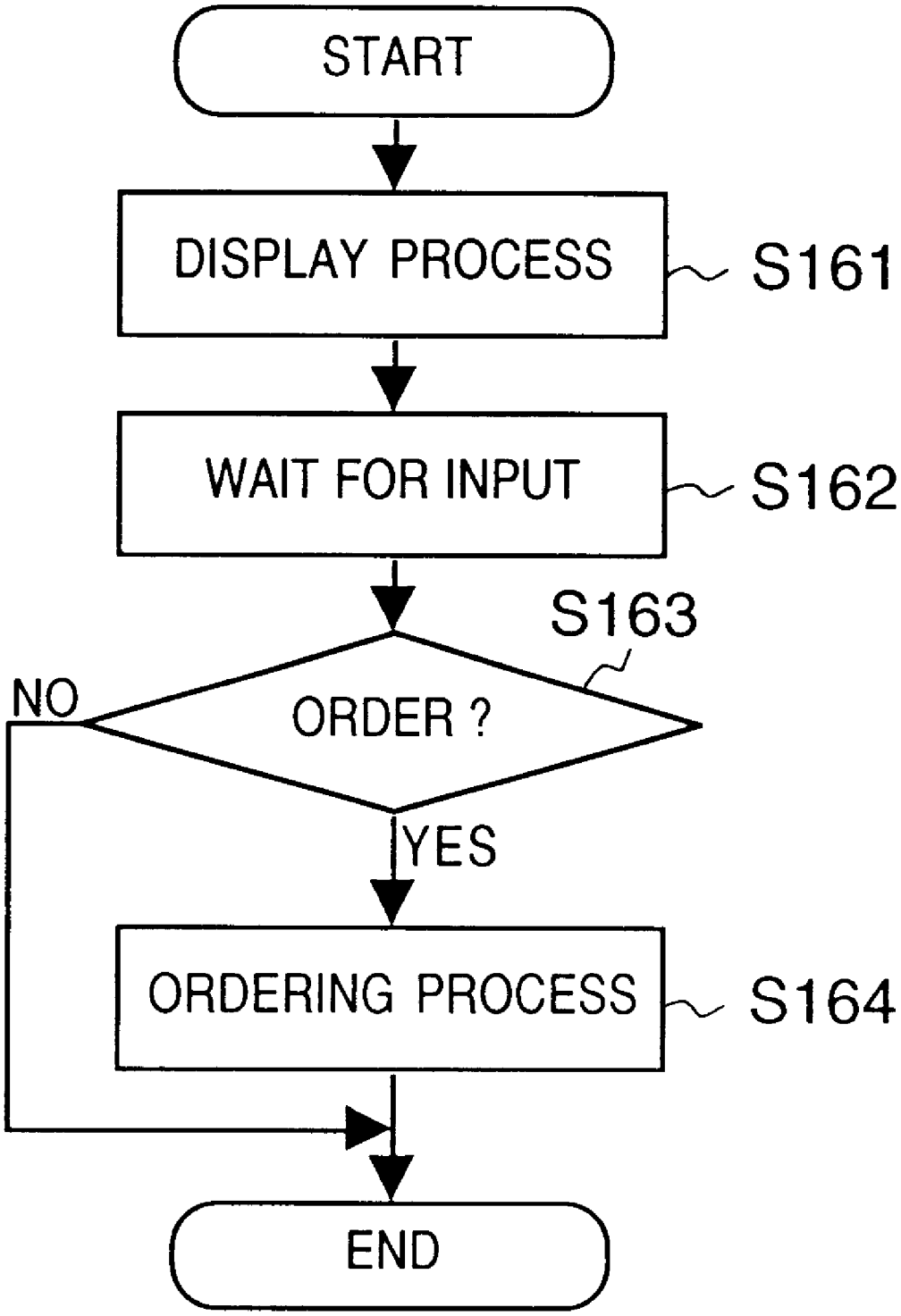
FIG. 15 is a flow chart of an order confirmation process.

FIG. 15 is a flow chart of an order confirmation process.

Figure 16:
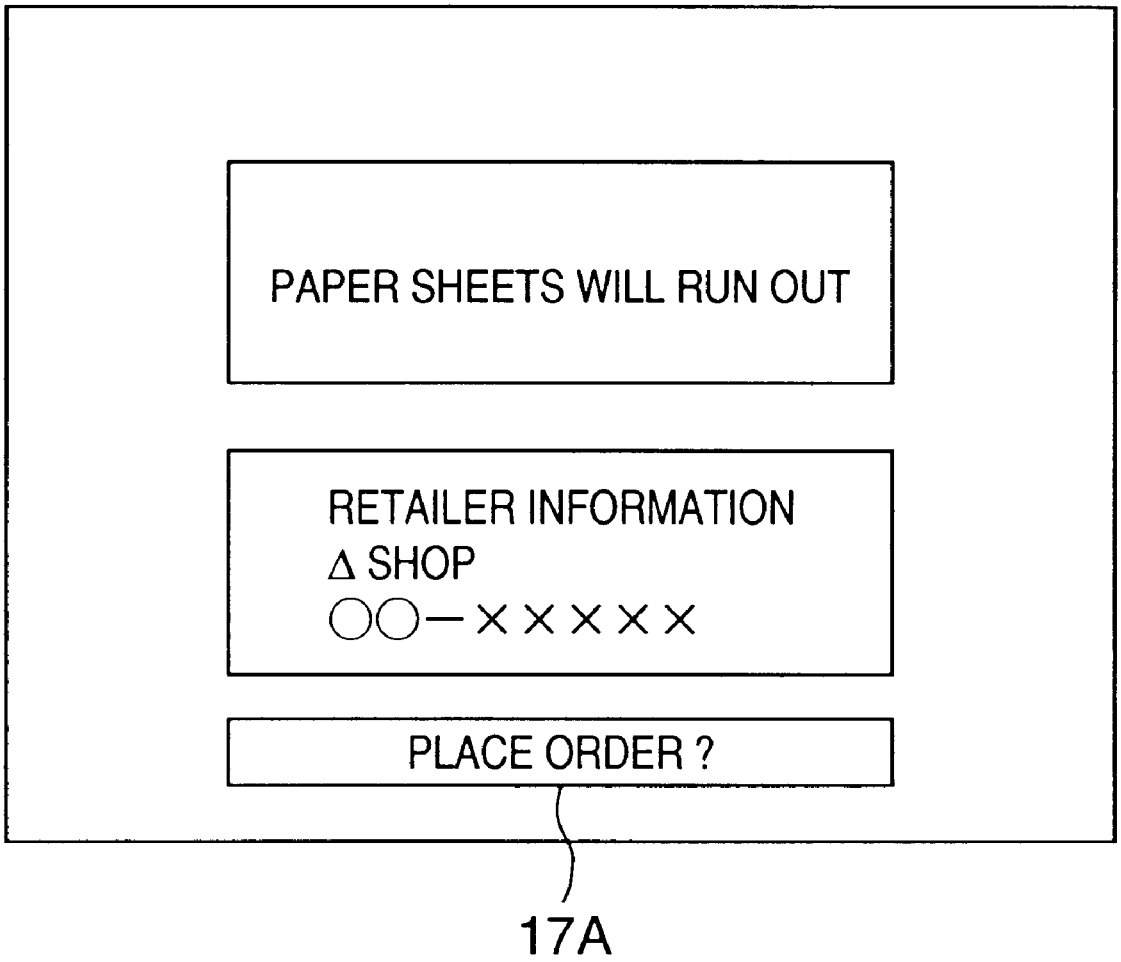
FIG. 16 shows a display example of a confirmation message of an ordering process.

If it is determined in the process shown in FIG. 2 or 3 that paper sheets are running short, a message asking the user if an order is to be placed is displayed (step S161). FIG. 16 shows a display example (17A) in such case. Note that an ordering process may be automatically executed without asking the user.

The control waits for an instruction from the input unit 7A (step S162), and it is then checked if an order instruction is input (step S163).

If the user inputs the order instruction, the flow advances to step S164 to execute an ordering process; otherwise, the flow ends.

Figure 17:
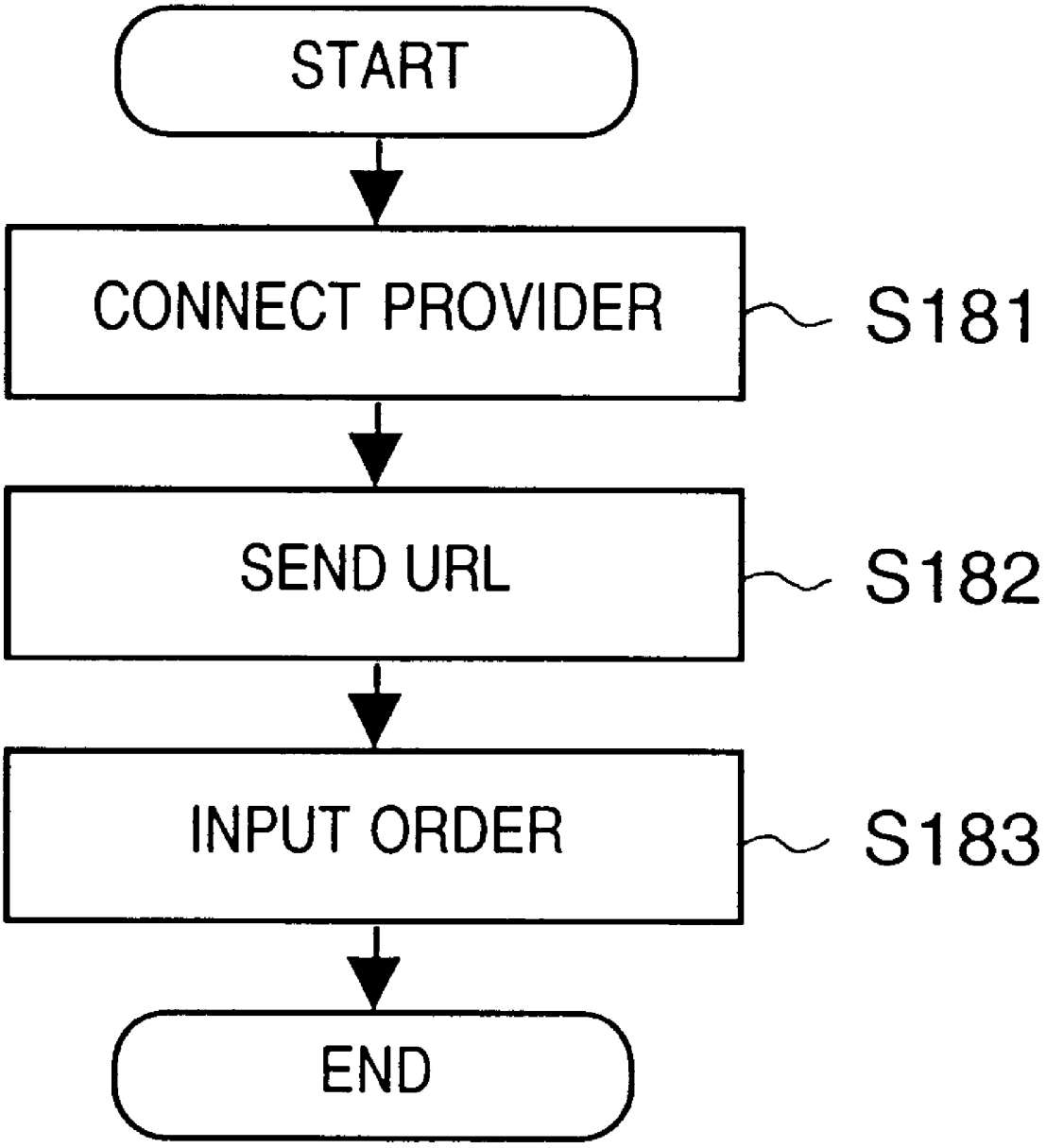
FIG. 17 is a flow chart of the ordering process.

FIG. 17 is a flow chart of the ordering process.

A connection process to the provider is executed (step S181), and the URL of the home page of the order destination is sent to open that home page (step S182). After that, the user inputs in accordance with a description on the home page, and places an order.

If expendables to be ordered are determined in advance, an order form may be automatically sent, thus saving input labor.

Alternatively, the aforementioned data unique to the apparatus may be sent together to automatically search for an order destination, and to execute an ordering process.

Furthermore, in the aforementioned example, the home page of the order destination is directly accessed. Alternatively, a FAX form, mail form, or the like may be prepared in advance, and may be displayed on the display unit 1D in the ordering process. After the user inputs required items, an order may be placed to a retailer via a FAX or mail.

Moreover, the apparatus may automatically call a retailer. In such case, a telephone line connection device such as a telephone set, modem, or the like may be connected to the communication unit 15A, which automatically places a call to a retailer, and after a connection is established, the user may talk via the telephone set to execute the ordering process. In this case, if the product name or the like of expendables which are running short is displayed on the display unit, an order error can be prevented.

Note that charging upon purchasing expendables may be made using a system similar to a pay-per-view system in data broadcast or the like.

Upon, e.g., establishing a dial-up connection to the Internet, the price for expendables may be added to the connection fee of the provider.

In either case, the retailer must make a contract with the provider.

The Internet or program provider itself may sell expendables, and smooth payment is allowed in such case.

In the above embodiments, only paper sheets have been explained as expendables. Also, the present invention can be applied to ink in an ink-jet printer, toner in an LBP, and the like. In such case, the remaining amount can be determined by measuring the consumed amount in an actual print process. Alternatively, a sensor for detecting the current remaining amount may be used.

As for the remaining amounts of expendables, the use states of expendables may be stored along with time, and the number of days until they are projected to run out may be estimated based on the stored values, or a threshold value of the remaining amount of expendables may be set in correspondence with the estimation result.

In the above embodiment, the telephone line is used to connect the Internet. Alternatively, a dedicated line, CATV, wireless means, and the like may be used.

(Second Embodiment)

Figure 18:
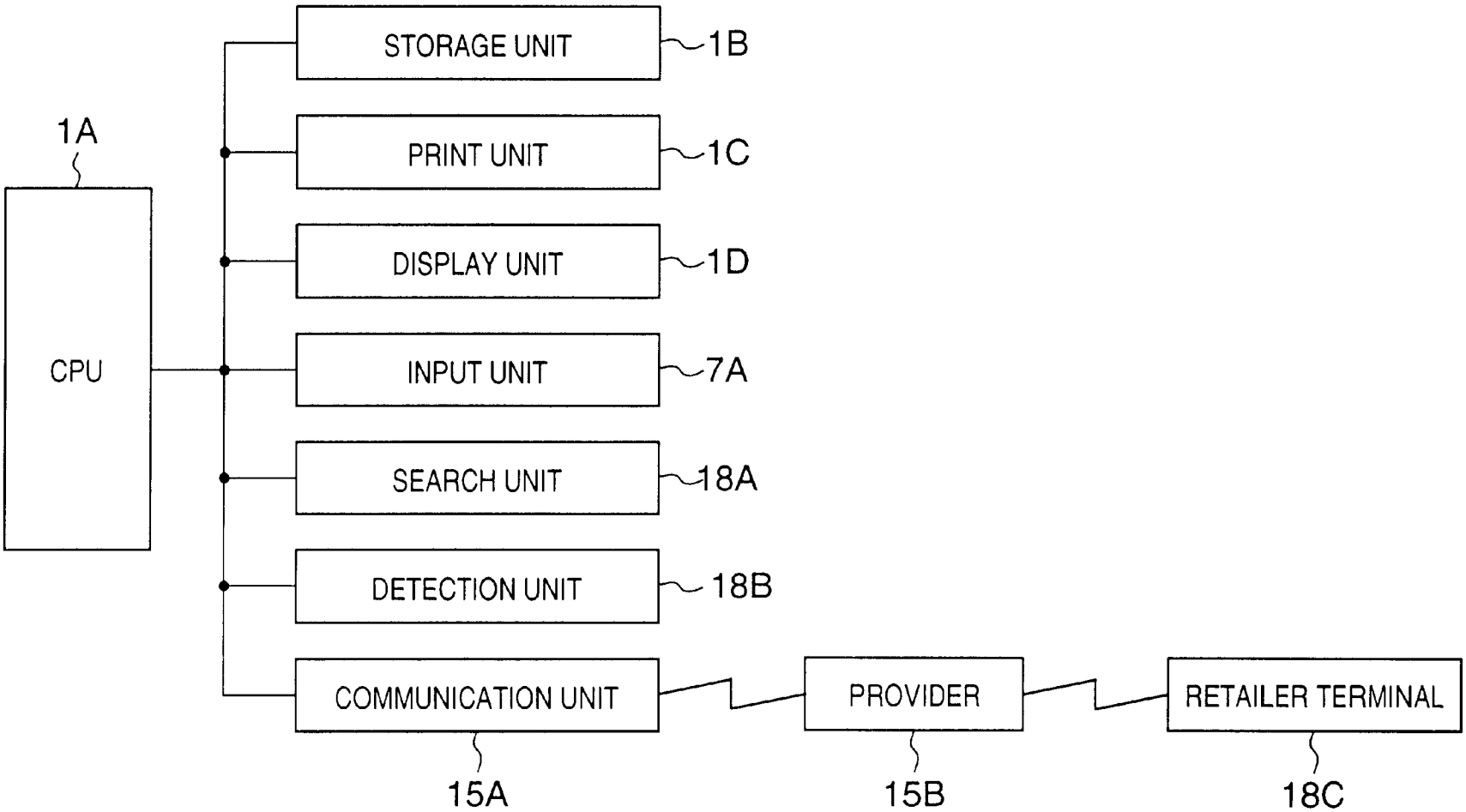
FIG. 18 is a block diagram showing a printing apparatus according another embodiment of the present invention.

FIG. 18 is a block diagram showing the arrangement of a printing apparatus according to the second embodiment. In FIG. 18, a search unit 18A, a detection unit 18B, and a retailer terminal 18C connected to a provider 15B via the Internet are added to the arrangement of FIG. 14. Note that arrangements in the provider 15B and retailer terminal 18C are the same as in FIG. 18 except for the absence of a print unit 1C, and a detailed description thereof will be omitted. Each of the units shown in FIG. 18 is controlled by CPU 1A.

The detection unit 18B has a function of detecting the remaining amount and use amount of expendables such as ink, toner, or paper, or the service life of photosensitive body, and a function of identifying whether a new expendable cartridge is attached when an expendable such as ink or toner is attached as a cartridge to a printing apparatus. The detection sensor 18B also has a function of calculating the running-out speed of expendables running out in a printing apparatus, and a function of roughly estimating from the calculated running-out speed and the remaining expendable amount a remaining period (time) for which expendables in use will completely run out. This function operates for ink, toner, paper, and a photosensitive body. The detection unit 18B can also be added to the arrangements in FIGS. 1, 6, 10, 11, and 14.

A storage unit 1B stores and manages setting information input by the user via an input unit 7A in advance, or search conditions.

When the detection unit 18B detects that expendables have run out, the search conditions stored in the storage unit 1B are referred to, and a search instruction based on the referred conditions is executed by the search unit 18A in the printing apparatus.

FIG. 19 shows an example of the search conditions stored in the storage unit 1B.

Reference numeral 19D denotes information for identifying the type of printing apparatus.

Reference numeral 19D denotes information which represents the type of each expendable used in the apparatus, and includes pieces of type information corresponding to paper 19A, ink 19B, and a photosensitive body 19C; and 19F, information including pieces of stock information (stock quantities of expendables) corresponding to the respective expendables 19A, 19B, and 19C. The stock information 19F has a function of decrementing the stock quantity of expendables by the use amount of expendables calculated by the detection unit 18B or the number of newly exchanged expendables.

Reference numeral 19G denotes a stock threshold value. The printing apparatus refers to the stock threshold value and stock information to determine whether to search for a retailer. This function is set when a printing apparatus is used in normal jobs of an office or the like, and expendables must be stocked. A user such as an individual user who does not require any stock needs not use this function.

Reference numeral 19H denotes a search timing as a set value for determining the timing at which search starts on the basis of a remaining period estimated by the detection unit 18B for which expendables will completely run out, as described above.

Reference numeral 19I denotes search cycle information for determining a cycle for searching for retailer information and expendables information for the respective types of expendables 19A, 19B, and 19C. Searching for retailer information (supplier) is conducted in several times by setting the search cycle, and an user may get expendables cheaper if price of expendables fluctuates or a new retailer and the like appear.

Reference numeral 19J denotes a price condition representing a desired condition which indicates the minimum discount for the price of expendables obtained by search.

Reference numeral 19K denotes the order quantity of expendables which is the number of expendables ordered at once.

Reference numeral 19L denotes a geographical condition representing a desired condition which indicates the distance to the retailer on the basis of, e.g., the address or map position set and stored in the printing apparatus. This condition may be set when an orderer wants to directly receive products. For example, the desired condition is represented as "near", "walkable", "twenty or thirty minutes by car" or "none". The "none" may be used as to expendables such as a photo conductor (photosensitive body) which can be not exchanged by user and is directly delivered by maintenance serviceman in general.

The default value of such setting information is input and set via the input unit 7A by an user who is near the printing apparatus and uses the apparatus, maintenance serviceman, or the like.

Other search conditions include the number of days taken for delivery, and the number of days taken to receive purchased products before expendables completely run out. In particular, the number of days taken for delivery, i.e., delivery time information may be set with a margin of about three days. This can prevent in advance a situation in which, e.g., retailer information, which meets set conditions except for the delivery time, is excluded from search results because only the delivery time condition is not satisfied. In addition, a remaining expendable usable period for which the detection unit 18B ends search, i.e., a search end timing may be set. By setting the search end timing, the user can acquire the search results of retailer information and product information before expendables completely run out. The printing apparatus may employ an arrangement which automatically displays search results on the display unit if the search end timing condition is satisfied (e.g., two days before expendables are predicted to completely run out). In this case, the user can efficiently acquire the search results. It is also achieved to give the order of priority to each item of set conditions, for example price, time of delivery, distance to a retailer and the like, according to the embodiment of this invention. For example, if the high priority is given to price, search results transmitted from the external provider are sorted in cheap order in advance at the external provider and this sorted data are displayed on the display unit of the printing apparatus or on a manager PC explained in the section for third embodiment, by the control unit. As a result, the user can efficiently and easily acquire search results closer to search results which fulfill conditions desired by the user.

Figure 20:
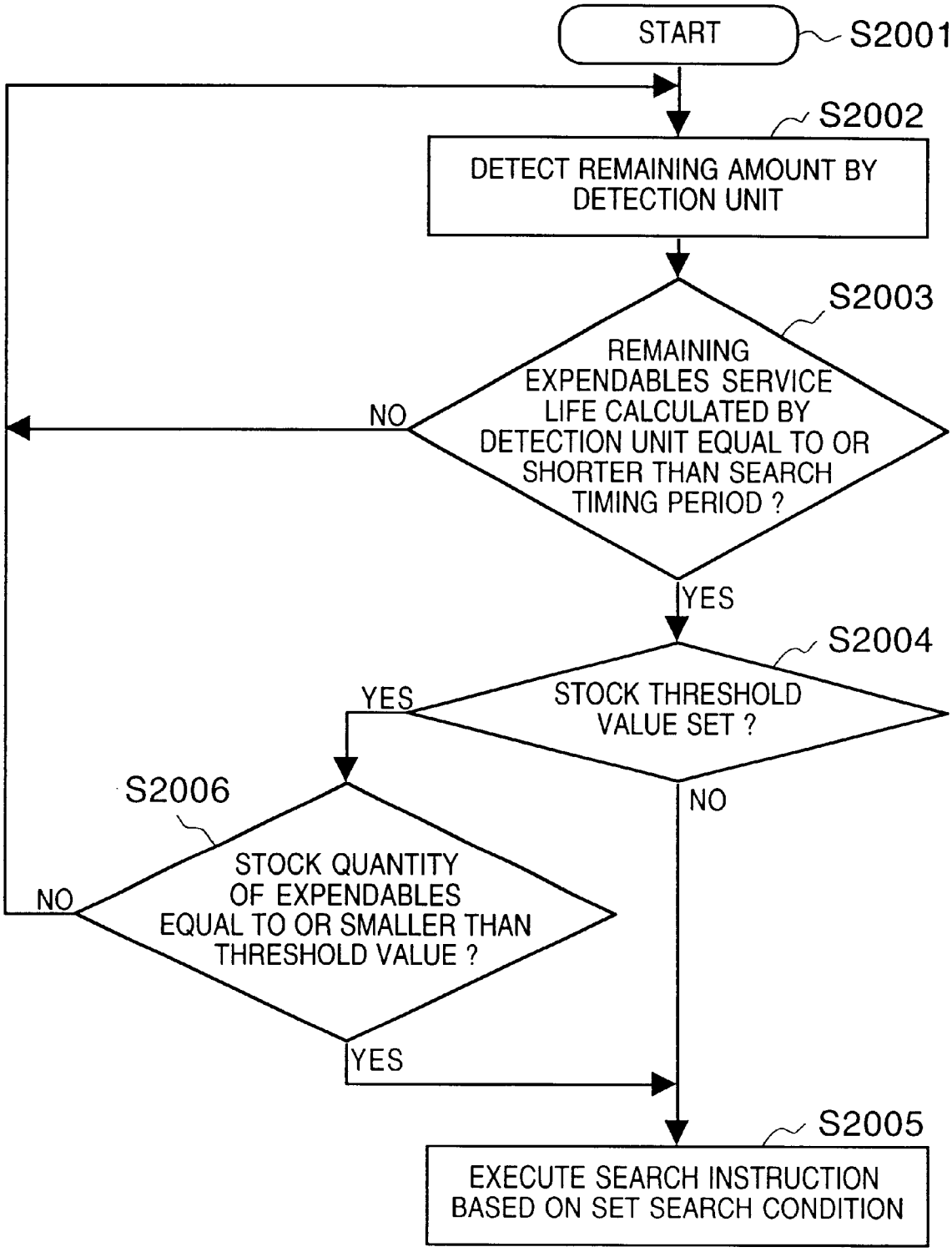
FIG. 20 is a flow chart showing the process of a search instruction to an external provider.

FIG. 20 is a flow chart showing execution of a search instruction based on the aforementioned search conditions in FIG. 19 by the search unit 18A.

In step S2002, the detection unit 18B detects the remaining amount of expendables used in the printing apparatus, and calculates a remaining period for which the expendables will completely run short.

In step S2003, whether the remaining expendable service life calculated in step S2002 is equal to or shorter than a period designated by a search timing is checked. If No in step S2003, the flow returns to step S2002; and if Yes, whether the stock information (stock quantity of expendables) 19F and the stock threshold value 19G are set in the printing apparatus is checked in step S2004. For an individual user who does not require any stock, the stock information (stock quantity of expendables) 19F and the stock threshold value 19G are not set and are invalid (NO in step S2004).

If No in step S2004, the search unit 18A issues in step S2005 a search instruction based on the search conditions set and stored in the storage unit 1B and transmits the search instruction to the communication unit 15A, and then a communication process based on the search instruction to the external provider 15B connected to the printing apparatus via the Internet is conducted by the communication unit 15A.

If Yes in step S2004, whether the set stock quantity of expendables is equal to or smaller than the stock threshold value is determined in step S2006. Note that the present invention assumes that determination in step S2006 includes determination of whether stock information (stock quantity of expendables) is smaller than the threshold value.

If No in step S2006, the flow advances to step S2002; and if Yes, the search unit 18A issues in step S2005 a search instruction based on the search conditions set and stored in the storage unit 1B and transmits the search instruction to the communication unit 15A, and then a communication process based on the search instruction to the external provider 15B connected to the printing apparatus via the Internet is conducted by the communication unit 15A.

The search process based on the search instruction of the printing apparatus is executed by the provider 15B on the basis of a database which stores retailer information, expendable information, and the like in the provider 15B connected outside the printing apparatus.

The retailer information and expendable information collected in the database of the provider 15B are transmitted from, e.g., the terminal device 18C of each retailer or an external server (not shown) connected outside the provider.

If the search instruction starts once under the search conditions stored in the storage unit 1B in step S2005, the search instruction is repeated in a set cycle until a communication unit 15A completes an order instruction input by the user via the input unit 7A, until the detection unit 18B recognizes attachment of new expendables, or until a end timing designated by the use.

FIG. 18 shows only one retailer terminal 18C. However, the present invention assumes an arrangement in which a plurality of retailer terminals 18C and an external server are connected to the provider 15B. Pieces of information from these retailer terminals and the external server are stored in and managed by the provider 15B.

Information searched by the provider 15B or the like in accordance with the search instruction is notified to the printing apparatus using a communication technique such as electronic mail and the printing apparatus receives the information. Further, the present invention also assumes that search results in the provider 15B are stored in the internal database of the provider 15B, and the printing apparatus is notified of only a URL or the like for browsing the database which stores the search results.

Pieces of information received by the printing apparatus in this way are stored and held in the storage unit 1B of the printing apparatus. The control means (CPU) of the printing apparatus displays the stored/held search result list on the display unit in accordance with a search result list call instruction by the user. When the printing apparatus is notified of the above-mentioned URL or the like, the printing apparatus, which internally stores a Web browser or the like for browsing the Internet, browses database information of the provider 15B using the Web browser.

FIGS. 21A and 21B show an example of a display window displayed on the display unit by the control means (CPU) in accordance with the search result list call instruction by the user. A column 21A displays search conditions, which correspond to the conditions shown in FIG. 19. A column 21B shows search results corresponding to the conditions of the column 21A, and represents the unit price of a product, the minimum order quantity of expendables, the location of a retailer, the number of days required for delivery, and remarks. The column 21B displays information provided by a retailer in addition to information corresponding to the search conditions. Information about the location of a retailer also includes a URL. Although not shown, if this display function is equipped with a function of sorting pieces of display information in the order of the price or in ascending order of the delivery time, a function more convenient for the user is realized, which is also assumed in the present invention. For example, a sort key is attached to the input unit 7A. With this arrangement, when the user requires supply of expendables, he/she can easily obtain useful expendable information from pieces of expendable information updated in the provider by a plurality of retailers, and can purchase expendables under desired conditions without any consciousness of out-of-expendable information or stock information. The search unit 18A transmits search instructions to the communication unit 15A only if necessary and the communication unit 15A executes it, which reduces the communication cost. Since retailer information and expendable information are periodically searched at a predetermined timing, the user can acquire expendable information updated every moment.

As another embodiment, the present invention also assumes an arrangement in which search results as described above are transmitted from a plurality of printing apparatuses such as a printer, FAX, copying machine, and composite machine to a manager computer connected in a connection network environment. With this arrangement, the manager can centralize the expendable order statuses of a plurality of computers.

(Third Embodiment)

In the above embodiment, search results are displayed on the display unit of a printing apparatus, or search conditions are set via the input unit of the printing apparatus. In the third embodiment, display of search results, setting of search conditions, and the like are performed by an expendable management computer installed on a LAN communicably connected to a printer, copying machine, FAX, personal computer, server apparatus, and the like.

Figure 22:
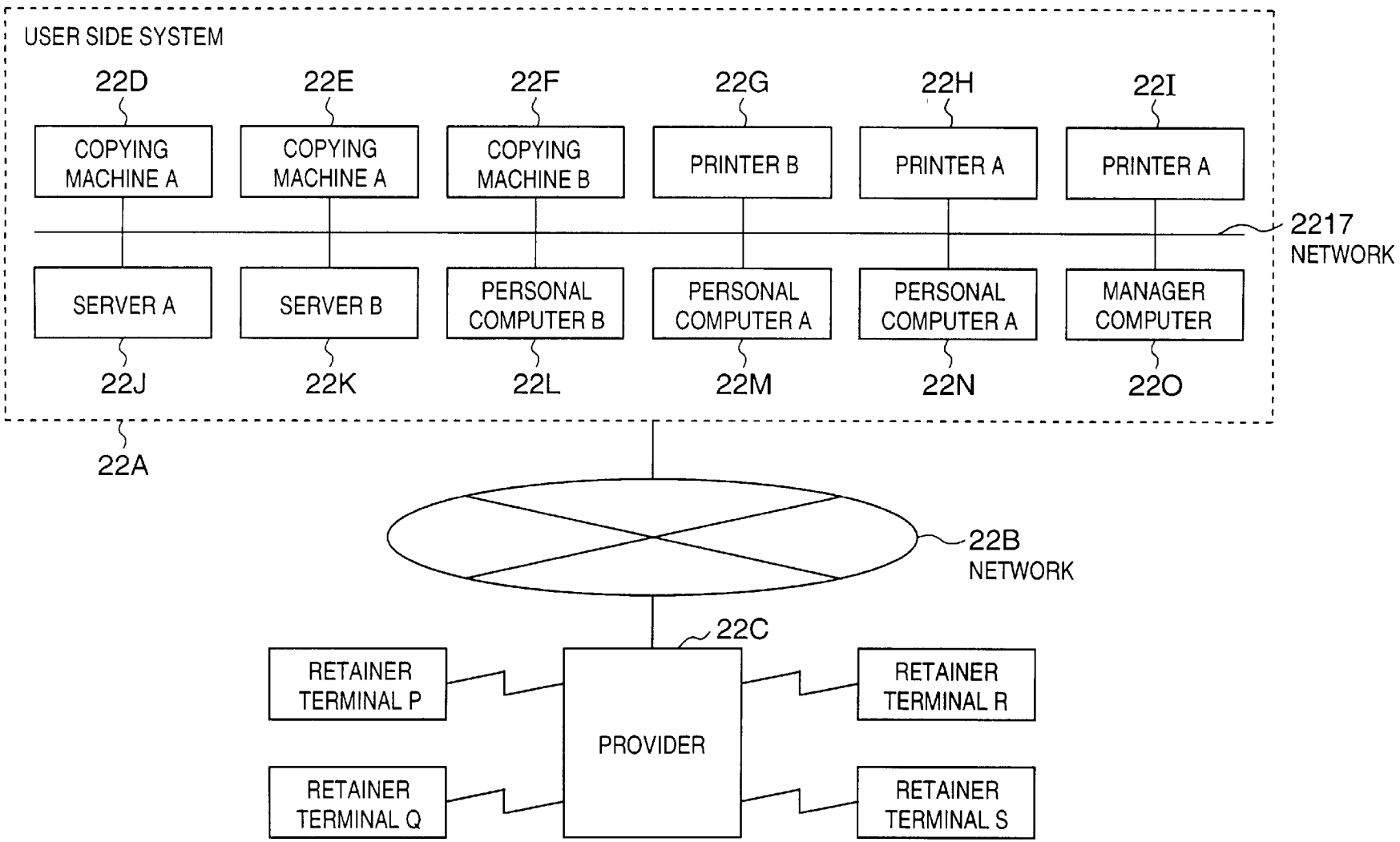
FIG. 22 is a block diagram showing an example of the topology of a manager computer and network system.

The system configuration is shown in FIG. 22. The arrangements of a copying machine, printer, and the like shown in FIG. 22 are the same as that of the above-described printing apparatus.

The arrangement of a manager computer is the same as that of a general-purpose computer, and a detailed description thereof will be omitted. This manager computer comprises at least a storage unit for storing a control program and various data, a display unit for displaying information, an input unit for inputting information, a communication unit for transmitting/receiving data, and a control unit for integrally controlling the storage unit, display unit, input unit, and communication unit.

Printing apparatuses such as a copying machine and printer have the same arrangement as that shown in FIG. 18. Each printing apparatus has a detection unit 18B. The detection unit 18B transmits the consumed amount or remaining amount of expendables to a manager computer 220.

The manager computer stores search condition information as shown in FIG. 19 for each of a plurality of devices such as a printer and copying machine. The display unit displays pieces of search condition information, and the manager can browse them.

The display unit of the manager computer displays a setting window for setting search conditions, and the manager can set search conditions as shown in FIG. 19 on the setting window for each device. When the manager computer manages many devices, the display unit displays a setting window capable of setting search conditions for all the devices at once.

The manager computer issues a search instruction based on set conditions to an external provider. When the search instruction is to be executed from the manager computer, e.g., a search time zone can be further set in the search conditions in FIG. 19, and a time during which the manager computer is not used can be designated. Such condition can also be applied to the printing apparatus described in the above embodiment. The search sequence based on search conditions is the same as the flow chart of FIG. 20 explained in the second embodiment except that remaining amount detection information in step S2002 is notified from the printing apparatus to the manager computer, and that the processes in steps S2002 to S2006 are performed by the manager computer.

A search result list may be notified by electronic mail from a provider 15B to the manager computer via the Internet. Alternatively, search results may be stored and managed in the internal database of the provider 15B, and a URL for accessing the database may be notified to the manager computer.

FIGS. 23A and 23B show an example of a display window displayed on the display unit, e.g., CRT of the manager computer. A column 23A shows search conditions, similar to FIG. 21. The difference from FIG. 21 is that the manager computer manages a plurality of devices and thus manages at once devices which use the same kind of expendables. At this time, pieces of stock information of expendables used in two types (AAA and GGG) of printing apparatuses are set, as represented by stock information (stock quantity of expendables) in the column 23A corresponding to FIG. 19.

A column 23B displays search results corresponding to the condition of column 23A.

In this fashion, the manager computer can set retailer information search conditions concerning purchase of expendables of a plurality of printing apparatuses, so conditions need not be intentionally set via the input unit of each printing apparatus. In addition, expendables of printing apparatuses which use the same kind of expendables can be managed at once, and a search result list about a plurality of devices can be browsed and managed at once by the manager computer. Hence, expendables can be efficiently managed.

As another embodiment in accordance with the present invention, the fourth embodiment applying the ordering process in the first embodiment to the second or third embodiment is provided. For example, in the fourth embodiment, ordering buttons (not shown in the drawings) corresponding to each of retailers included in a search result displayed on the display unit of the printing apparatus or manager computer as shown in FIG. 21 or 23 is provided and displayed. The printing apparatus, CPU in the manager computer or the like determines whether or not there is input to the ordering buttons. Applying such an input determination to the process in the step S162 shown in FIG. 15, it can be achieved to add the ordering function to the functions of the second or third embodiment.

Further, applying step S204 in the flowchart shown in FIG. 2 to the process of step S2003 shown in FIG. 20 or step S2003 in the third embodiment shown in FIG. 20, another embodiment as fifth embodiment of the present invention is provided wherein search instruction based on the search conditions shown in FIG. 19 is conducted by the printing apparatus or the manager computer when the number of papers used in the printing apparatus is less than a predetermined amount.

Further, if search instructions in the printing apparatus in the second embodiment is conducted to the manager computer in the third embodiment, another embodiment as sixth embodiment of the present invention is provided wherein the whole search of a plurality of the printing apparatuses can be conducted on the manager computer. For example, if the search instructions (search requirement) based on the search conditions stored in each printing apparatus such as the copying machine, printer shown in FIG. 22 and the like are transmitted to the manager computer, the manager computer manages circumstances of the search requirements received from the printing apparatus and can display the circumstances by display control means. Ordering control means (control means) of the manager computer collectively operates a plurality of the search requirements from the printing apparatuses, so that a plurality of the search requirements from the printing apparatuses to the external provider can be collectively conducted.

In this case, if the search requirements of the printing apparatuses are transmitted to the manager computer with the search conditions, control means of the manager computer can conduct the search instructions corresponding to the search conditions of the printing apparatus to the external provider collectively. As a result, the communication cost will be reduced more and the manager need not set the search conditions to all the printing apparatuses while the search conditions set on the printing apparatus are set by an user who is near the printing apparatus and, maintenance serviceman, or the like as explained in the second embodiment. Thus the burdens on the manager will be reduced.

Further, seventh embodiment, to be applying the sixth embodiment to the ordering process of the fourth embodiment, of the present invention is provided. In the seventh embodiment, search instructions for retailer information (supplier information) are conducted by control means in a manner described in the sixth embodiment, and then ordering buttons corresponding to the supplier information included in the search result are displayed by display control means of the manager computer. When the ordering button is inputted, ordering process will be conducted.

Further, the second and third embodiments have exemplified a system of searching for retailer data in a server. As another embodiment, it is also possible that the user inputs conditions and a retailer makes an offer. In this case, the user can obtain good results as for both the cost and delivery time. As a system which provides such environment, retailers who have made offers, and user information are disclosed to make offers and orders more safely between the user and the retailer. That is, information representing occurrence of a delivery time delay or the past transaction amount is disclosed to clear the transaction risk.

Accordingly, the user can safely make a transaction with an unknown retailer.

Further, the program stored in the storage unit mentioned above and shown in FIGS. 2, 3, 12, 15, 17 and 20 is conducted by the CPU 1A.

As described above, this embodiment can quickly cope with a short supply of expendables.

Note that the objects of the present invention are also achieved by supplying a storage medium (or recording medium), which records a program code of a software program that can implement the functions of the above-mentioned embodiments to a system or apparatus, and reading out and executing the program code stored in the storage medium by a computer (or a CPU or MPU) of the system or apparatus. In this case, the program code itself read out from the storage medium implements the functions of the above-mentioned embodiments, and the storage medium which stores the program code constitutes the present invention. The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension card or a function extension unit, which is inserted in or connected to the computer, after the program code read out from the storage medium is written in a memory of the extension card or unit.

As many apparently widely different embodiments of the present invention can be made without departing from the spirit and scope thereof, it is to be understood that the invention is not limited to the specific embodiments thereof except as defined in the claims.

What is claimed is:

1. A printing apparatus comprising:

recognition means for recognizing either a remaining amount or a use amount of a predetermined expendable;

accessing means for accessing an external database storing expendable supplier information based on a recognition result of said recognition means and acquiring the expendable supplier information from the external database;

display control means for displaying one or more suppliers based on the acquired expendable supplier information; and a storage unit storing search conditions, wherein said accessing means requests the external database to search for the expendable supplier information on the basis of the search conditions stored on said storage unit and acquires the expendable supplier information from the external database.

2. The printing apparatus according to claim 1, wherein said accessing means requests the external database to search for the expendable supplier information on the basis of search conditions including at least information unique to said printing apparatus and acquires the expendable supplier information searched on the basis of the unique information from the external database.

3. The printing apparatus according to claim 2, wherein the unique information includes an installation address of said printing apparatus, and said accessing means requests the external database to search for the expendable supplier information which pertains to a supplier near the address.

4. The printing apparatus according to claim 1, wherein said accessing means accesses the external database every predetermined period, and said printing apparatus further comprises storage means for storing the predetermined period.

5. The printing apparatus according to claim 1, wherein the search conditions includes plural kinds of search items, and said printing apparatus farther comprises setting means for setting the search items on said storage unit.

6. A printing apparatus comprising:

recognition means for recognizing either a remaining amount or a use amount of a predetermined expendable;

accessing means for accessing an external database storing expendable supplier information based on a recognition result of said recognition means and acquiring the expendable supplier information from the external database; and display control means for displaying one or more suppliers based on the acquired expendable supplier information; wherein the expendable supplier information includes a URL, and said printing apparatus further comprises a browser for browsing the Web page indicated by the URL.

7. A printing apparatus comprising:

recognition means for recognizing either a remaining amount or a use amount of a predetermined expendable;

accessing means for accessing an external database storing expendable supplier information based on a recognition result of said recognition means and acquiring the expendable supplier information from the external database;

display control means for displaying one or more suppliers based on the acquired expendable supplier information; and calculating means for calculating the running-out speed of the expendable and calculating a remaining period for which the expendable in use will completely run out based on the running-out speed, wherein said accessing means accesses the external database at a timing determined based on the remaining period.

8. An external apparatus connected to a printing apparatus comprising:

receiving means for receiving information indicating that a remaining amount or a use amount of a predetermined expendable reaches a predetermined amount from the printing apparatus;

accessing means for accessing an external database storing expendable supplier information based on the received information and acquiring the expendable supplier information from the external database;

display control means for displaying one or more suppliers based on the acquired expendable supplier information; and a storage unit storing search conditions, wherein said accessing means requests the external database to search for the expendable supplier information on the basis of the search conditions stored on said storage unit and acquires the expendable supplier information from the external database.

9. The external apparatus according to claim 8, wherein said accessing means requests the external database to search for the expendable supplier information on the basis of search conditions including at least information unique to said printing apparatus and acquires the expendable supplier information searched on the basis of the unique information from the external database.

10. The external apparatus according to claim 9, wherein the unique information includes an installation address of said printing apparatus, and said accessing means requests the external database to search for the expendable supplier information which pertains to a supplier near the address.

11. The external apparatus according to claim 8, wherein said accessing means accesses the external database every predetermined period, and said external apparatus further comprises storage means for storing the predetermined period.

12. The external apparatus according to claim 8, wherein the search conditions includes plural kinds of search items, and said external apparatus further comprises setting means for setting the search items on said storage unit.

13. An external apparatus connected to a printing apparatus comprising:

receiving means for receiving information indicating that a remaining amount or a use amount of predetermined expendable reaches a predetermined amount from the printing apparatus;

accessing means for accessing an external database storing expendable supplier information based on the received information and acquiring the expendable supplier information from the external database; and display control means for displaying one or more suppliers based on the acquired expendable supplier information; wherein the expendable supplier information includes a URL, and said external apparatus further comprises a browser for browsing the Web page indicated by the URL.

14. An external apparatus connected to a printing apparatus comprising:

receiving means for receiving information indicating that a remaining amount or a use amount of a predetermined expendable reaches a predetermined amount from the printing apparatus;

accessing means for accessing an external database storing expendable supplier information based on the received information and acquiring the expendable supplier information from the external database;

displaying control means for displaying one or more suppliers based on the acquired expendable supplier information; and calculating means for calculating the running-out speed of the expendable and calculating a remaining period for which the expendable in use will completely run out based on the running-out speed, wherein said accessing means accesses the external database at a timing determined based on the remaining period.

15. A method for a printing apparatus comprising:

recognition step of recognizing either a remaining amount or a use amount of a predetermined expendable;

accessing step of accessing an external database storing expendable supplier information based on a recognition result of said recognition step and acquiring the expendable supplier information for the external database;

display control step of displaying one or more suppliers based on the acquired expendable supplier information; and storing step of storing search conditions, wherein said accessing step requests the external database to search for the expendable supplier information on the basis of the search conditions stored in said storing step and acquires the expendable supplier information from the external database.

16. A method for a printing apparatus comprising:

recognition step of recognizing either a remaining amount or a use amount of a predetermined expendable;

accessing step of accessing an external database storing expendable supplier information based on a recognition result of said recognition step and acquiring the expendable supplier information from the external database; and display control step of displaying one or more suppliers based on the acquired expendable supplier information, wherein the expendable supplier information includes a URL, and said method further comprises browsing step of browsing the Web page indicated by the URL.

17. A method for a printing apparatus comprising:

recognition step of recognizing either a remaining amount or a use amount of a predetermined expendable;

accessing step of accessing an external database storing expendable supplier information based on a recognition result of said recognition step and acquiring the expendable supplier information from the external database;

display control step of displaying one or more suppliers based on the acquired expendable supplier information; and calculating step of calculating the running-out speed of the expendable and calculating a remaining period for which the expendable in use will completely run out based on the running-out speed, wherein said accessing step accesses the external database at a timing determined based on the remaining period.

18. A method for an external apparatus connected to a printing apparatus comprising:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database;

display control step of displaying one or more suppliers based on the acquired expendable supplier information; and storing step of storing search conditions, wherein said accessing step requests the external database to search for the expendable supplier information on the basis of the search conditions stored in said storing step and acquires the expendable supplier information from the external database.

19. A method for an external apparatus connected to a printing apparatus comprising:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database; and display control step of displaying one or more suppliers based on the acquired expendable supplier information, wherein the expendable supplier information includes a URL, and said method further comprises browsing step of browsing the Web page indicated by the URL.

20. A method for an external apparatus connected to a printing apparatus comprising:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database;

display control step of displaying one or more suppliers based on the acquired expendable supplier information; and calculating step of calculating the running-out speed of the expendable and calculating a remaining period for which the expendable in use will completely run out based on the running-out speed, wherein said accessing step accesses the external database at a timing determined based on the remaining period.

21. A program for making a printing apparatus execute the steps of:

recognition step of recognizing either a remaining amount or a use amount of a predetermined expendable;

accessing step of accessing an external database storing expendable supplier information based on a recognition result of said recognition step and acquiring the expendable supplier information from the external database;

display control step of displaying one or more suppliers based on the acquired expendable supplier information; and storing step of storing search conditions, wherein said accessing step requests the external database to search for the expendable supplier information on the basis of the search conditions stored in said storing step and acquires the expendable supplier information from the external database.

22. A program for making a printing apparatus execute the steps of:

recognition step of recognizing either a remaining amount or a use amount of a predetermined expendable;

accessing step of accessing an external database storing expendable supplier information based on a recognition result of said recognition step and acquiring the expendable supplier information from the external database; and display control step of displaying one or more suppliers based on the acquired expendable supplier information, wherein the expendable supplier information includes a URL, and said method further comprises browsing step of browsing the Web page indicated by the URL.

23. A program for making a printing apparatus execute the steps of:

recognition step of recognizing either a remaining amount or a use amount of a predetermined expendable;

accessing step of accessing an external database storing expendable supplier information based on a recognition result of said recognition step and acquiring the expendable supplier information from the external database;

display control step of displaying one or more suppliers based on the acquired expendable supplier information; and calculating step of calculating the running-out speed of the expendable and calculating a remaining period for which the expendable in use will completely run out based on the running-out speed, wherein said accessing step accesses the external database at a timing determined based on the remaining period.

24. A program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database;

display control step of displaying one or more suppliers based on the acquired expendable supplier information; and storing step of storing search conditions, wherein said accessing step requests the external database to search for the expendable supplier information on the basis of the search conditions stored in said storing step and acquires the expendable supplier information from the external database.

25. A program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database; and display control step of displaying one or more suppliers based on the acquired expendable supplier information, wherein the expendable supplier information includes a URL, and said method further comprises browsing step of browsing the Web page indicated by the URL.

26. A program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing expendable supplier information based on the received information and acquiring the expendable supplier information from the external database;

display control step of displaying one or more suppliers based on the acquired expendable supplier information; and calculating step of calculating the running-out speed of the expendable and calculating a remaining period for which the expendable in use will completely run out based on the running-out speed, wherein said accessing step accesses the external database at a timing determined based on the remaining period.

27. A printing apparatus comprising:

recognition means for recognizing either a remaining amount or a use amount of a predetermined expendable;

accessing means for accessing an external database storing information relevant to the expendable based on a recognition result of said recognition means and acquiring the information from the external database;

display control means for displaying one or more information based on the information acquired by said accessing means; and a storage unit storing search conditions including plural kinds of search items which are used in each accessing of the external database by said accessing means, wherein said accessing means requests the external database to search for the information relevant to the expendable on the basis of the search conditions stored in said storage unit.

28. An external apparatus connected to a printing apparatus comprising:

receiving means for receiving information indicating that a remaining amount or a use amount of a predetermined expendable reaches a predetermined amount from the printing apparatus;

accessing means for accessing an external database storing information relevant to the expendable based on the received information and acquiring the information from the external database;

display control means for displaying one or more information based on the information acquired by said accessing means; and a storage unit storing search conditions including plural kinds of search items which are used in each accessing of the external database by said accessing means, wherein said accessing means requests the external database to search for the information relevant to the expendable on the basis of the search conditions stored in said storage unit.

29. A method for an external apparatus connected to a printing apparatus comprising:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more suppliers based on the information acquired by said accessing step; and storing step of storing search conditions including plural kinds of search items which are used in each accessing of the external database by said accessing step, wherein said accessing step requests the external database to search for the information relevant to the expendable on the basis of the search conditions stored in said storing step.

30. A recording medium which records a program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more suppliers based on the information acquired by said accessing step; and storing step of storing search conditions including plural kinds of search items which are used in each accessing of the external database by said accessing step, wherein said accessing step requests the external database to search for the information relevant to the expendable on the basis of the search conditions stored in said storing step.

31. A program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more suppliers based on the information acquired by said accessing step; and storing step of storing search conditions including plural kinds of search items which are used in each accessing of the external database by said accessing step, wherein said accessing step requests the external database to search for the information relevant to the expendable on the basis of the search conditions stored in said storing step.

32. A printing apparatus comprising:

recognition means for recognizing either a remaining amount or a use amount of a predetermined expendable;

accessing means for accessing an external database storing information relevant to the expendable based on a recognition result of said recognition means and acquiring the information from the external database;

display control means for displaying one or more information based on the information acquired by said accessing means; and a storage unit storing a search condition relevant to price, wherein said accessing means requests the external database to search for the information relevant to the expendable on the basis of the search condition stored on said storage unit.

33. An external apparatus connected to a printing apparatus comprising:

receiving means for receiving information indicating that a remaining amount or a use amount of a predetermined expendable reaches a predetermined amount from the printing apparatus;

accessing means for accessing an external database storing information relevant to the expendable based on the received information and acquiring the information from the external database;

display control means for displaying one or more information based on the information acquired by said accessing means; and a storage unit storing a search condition relevant to price, wherein said accessing means requests the external database to search for the information relevant to the expendable on the basis of the search condition stored in said storage unit.

34. A method for an external apparatus connected to a printing apparatus comprising:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more information based on the information acquired by said accessing step; and storing step of storing a search condition relevant to price, wherein said accessing step requests the external database to search for the information relevant to the expendable on the basis of the search condition stored in said storing step.

35. A recording medium which records a program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more information based on the information acquired by said accessing step; and storing step of storing a search condition relevant to price, wherein said accessing step requests the external database to search for the information relevant to the expendable on the basis of the search condition stored in said storing step.

36. A program for making an external apparatus connected to a printing apparatus execute the steps of:

receiving step of receiving information indicating that a remaining amount or a use amount of a predetermined expendable reaches a predetermined amount from the printing apparatus;

accessing step of accessing an external database storing information relevant to the expendable based on the received information and acquiring the information from the external database;

display control step of displaying one or more information based on the information acquired by said accessing step; and storing step of storing a search condition relevant to price, wherein said accessing step requests the external database to search for the information relevant to the expendable on the is of the search condition stored in said storm step.

* * * * *